US011064580B2

(12) United States Patent
Taschuk et al.

(10) Patent No.: US 11,064,580 B2
(45) Date of Patent: Jul. 13, 2021

(54) SYSTEMS AND METHODS FOR ILLUMINATION, MONITORING, OR COORDINATING ILLUMINATION OR MONITORING ACROSS AN AREA

(71) Applicant: G2V OPTICS INC., Edmonton (CA)

(72) Inventors: Michael Thomas Taschuk, Edmonton (CA); Ryan Thomas Tucker, Edmonton (CA)

(73) Assignee: G2V OPTICS INC., Edmonton (CA)

( * ) Notice: Subject to any disclaimer, the term of this patent is extended or adjusted under 35 U.S.C. 154(b) by 0 days.

(21) Appl. No.: 17/052,428

(22) PCT Filed: May 1, 2019

(86) PCT No.: PCT/CA2019/050574

§ 371 (c)(1),
(2) Date: Nov. 2, 2020

(87) PCT Pub. No.: WO2019/210416

PCT Pub. Date: Nov. 7, 2019

(65) Prior Publication Data

US 2021/0092818 A1 Mar. 25, 2021

(30) Foreign Application Priority Data

May 2, 2018 (CA) ..... CA 3004005
May 2, 2018 (CA) ..... CA 3004011

(51) Int. Cl.
*H05B 45/12* (2020.01)
*H05B 47/19* (2020.01)
(Continued)

(52) U.S. Cl.
CPC ..... *H05B 45/00* (2020.01); *H05B 45/12* (2020.01); *H05B 45/18* (2020.01); *H05B 45/22* (2020.01);
(Continued)

(58) Field of Classification Search
None
See application file for complete search history.

(56) References Cited

U.S. PATENT DOCUMENTS 3,066,445 A 12/1962 D'Amico
6,979,097 B2 12/2005 Elam et al.
(Continued)

FOREIGN PATENT DOCUMENTS

EP 2470829 A2 7/2012
WO 2006/127785 A2 11/2006
WO 2017/140746 A1 8/2017

OTHER PUBLICATIONS

International Search Report issued by the Canadian Intellectual Property Office dated Aug. 27, 2019 in connection with International Patent Application No. PCT/CA2019/050574, 16 pages.
(Continued)

*Primary Examiner* — Dedei K Hammond

(57) ABSTRACT

According to one embodiment, there is provided a method of controlling a first at least one illumination apparatus releasably connected to a first at least one of a plurality of connection regions of a first support body. The method involves controlling at least one characteristic of light emitted from the first at least one illumination apparatus in response to at least one measurement from a sensor apparatus. Other systems and methods are also disclosed.

4 Claims, 16 Drawing Sheets

(51) Int. Cl.

| | |
|---|---|
| ***H05B 45/00*** | (2020.01) |
| ***H05B 45/28*** | (2020.01) |
| ***H05B 47/155*** | (2020.01) |
| ***H05B 45/22*** | (2020.01) |
| ***H05B 45/18*** | (2020.01) |
| ***H05B 47/105*** | (2020.01) |
| *F21Y 115/10* | (2016.01) |
| *F21V 17/00* | (2006.01) |

(52) U.S. Cl.
CPC ..... *H05B 45/28* (2020.01); *H05B 47/105* (2020.01); *H05B 47/155* (2020.01); *F21V 17/002* (2013.01); *F21Y 2115/10* (2016.08)

(56) References Cited

U.S. PATENT DOCUMENTS

| | | | |
|---|---|---|---|
| 8,080,819 | B2 | 12/2011 | Mueller et al. |
| 8,113,687 | B2 | 2/2012 | Villard et al. |
| 8,376,583 | B2 | 2/2013 | Wang et al. |
| 8,519,424 | B2 | 8/2013 | Hammond et al. |
| 8,531,134 | B2 | 9/2013 | Chemel et al. |
| 8,847,514 | B1 | 9/2014 | Reynoso et al. |
| 8,850,742 | B2 | 10/2014 | Dube |
| 9,060,468 | B2 | 6/2015 | Klase et al. |
| 9,357,718 | B1 | 6/2016 | Lehman et al. |
| 9,541,261 | B2 * | 1/2017 | Klase ..... F21V 14/02 |
| 2009/0025287 | A1 | 1/2009 | Lee |
| 2010/0001648 | A1 | 1/2010 | De Clercq et al. |
| 2010/0039804 | A1 | 2/2010 | Budde et al. |
| 2012/0104977 | A1 | 5/2012 | McKenzie et al. |
| 2012/0218750 | A1 | 8/2012 | Klase et al. |
| 2013/0006401 | A1 | 1/2013 | Shan |
| 2015/0128488 | A1 | 5/2015 | Casper et al. |
| 2016/0374273 | A1 | 12/2016 | Quazi |
| 2017/0020084 | A1 | 1/2017 | Alfier et al. |
| 2017/0023187 | A1 | 1/2017 | Kong |
| 2017/0079216 | A1 | 3/2017 | Quazi |
| 2017/0350564 | A1 | 12/2017 | Mellor et al. |
| 2020/0333422 | A1 * | 10/2020 | Brandt-Pearce .... H04L 25/0212 |

OTHER PUBLICATIONS

Written Opinion of the International Searching Authority issued by the Canadian Intellectual Property Office dated Aug. 27, 2019 in connection with International Patent Application No. PCT/CA2019/050574, 9 pages.

R.J. Bula et al., "Light-emitting Diodes as a Radiation Source for Plants", Hortscience, vol. 26(2), Feb. 1991, pp. 203-205, U.S.A.

Kevin M. Folta et al., "Design and fabrication of adjustable red-green-blue LED light arrays for plant research", http://www.biomedcentral.com/1471-2229/5/17, Methodology article, BioMed Central Ltd., BMC Plant Biology 2005, 5:17, Aug. 23, 2005, pp. 1-11, U.S.A.

* cited by examiner

SYSTEMS AND METHODS FOR ILLUMINATION, MONITORING, OR COORDINATING ILLUMINATION OR MONITORING ACROSS AN AREA

CROSS-REFERENCE TO RELATED APPLICATIONS

This application claims the benefit of and priority to Canadian patent application nos. 3,004,005 and 3,004,011, both filed on May 2, 2018, the entire contents of both of which are incorporated by reference herein.

FIELD

This disclosure relates generally to systems and methods for illumination, monitoring, coordinating illumination across an area, coordinating monitoring across an area, or a combination of two or more thereof.

RELATED ART

Illumination systems may, for example, facilitate or control plant growth. However, different phases and different types of plant growth may be facilitated by different types of light, and some illumination systems are not configurable to produce light that can vary by different phases or different types of plant growth, for example. Further, some illumination systems are not also capable of operating as sensors.

SUMMARY

According to one embodiment, there is provided a method of controlling a first at least one illumination apparatus releasably connected to a first at least one of a plurality of connection regions of a first support body, the method comprising controlling at least one characteristic of light emitted from the first at least one illumination apparatus in response to at least one measurement from a sensor apparatus.

In some embodiments, controlling the at least one characteristic comprises controlling at least one frequency spectrum of light emitted by the first at least one illumination apparatus.

In some embodiments, controlling the at least one characteristic comprises controlling an intensity of light emitted by the first at least one illumination apparatus.

In some embodiments, the sensor apparatus is releasably connected to a second one of the plurality of connection regions of the first support body.

In some embodiments, the sensor apparatus is releasably connected to one of a plurality of connection regions of a second support body spaced apart from the first support body.

In some embodiments, a first at least one interchangeable module comprises the first at least one illumination apparatus and a second at least one interchangeable module comprises the sensor apparatus.

In some embodiments, a single interchangeable module comprises the first at least one illumination apparatus and the sensor apparatus.

In some embodiments, controlling the at least one characteristic of the first at least one illumination apparatus comprises controlling the at least one characteristic of a single illumination apparatus.

In some embodiments, the at least one measurement comprises a measurement of light emitted from the single illumination apparatus.

In some embodiments, the at least one measurement comprises a measurement of light emitted from a second at least one illumination apparatus different from the single illumination apparatus.

In some embodiments, controlling the at least one characteristic of the first at least one illumination apparatus comprises controlling the at least one characteristic of a first plurality of illumination apparatuses.

In some embodiments, the at least one measurement comprises a measurement of light emitted from at least one of the first plurality of illumination apparatuses.

In some embodiments, the at least one measurement comprises a measurement of light emitted from a second at least one illumination apparatus different from the first plurality of illumination apparatuses.

In some embodiments, the at least one measurement comprises a measurement of light.

In some embodiments, the measurement of light comprises a measurement of light emitted from a second plurality of illumination apparatuses.

In some embodiments, the measurement of light comprises: a measurement of a first frequency spectrum of light emitted from a first one of the second plurality of illumination apparatuses; and a measurement of a second frequency spectrum of light different from the first frequency spectrum of light and emitted from a second one of the second plurality of illumination apparatuses.

In some embodiments, the at least one measurement comprises a measurement of temperature.

In some embodiments, the measurement of temperature comprises a measurement of temperature internal to the sensor apparatus.

In some embodiments, the measurement of temperature comprises a measurement of temperature external to the sensor apparatus.

In some embodiments, the first at least one illumination apparatus is configured to configure at least one parameter of the first at least one illumination apparatus automatically in response to releasable connection of the first at least one illumination apparatus to a connection region of a support body.

In some embodiments, the at least one parameter of the first at least one illumination apparatus comprises at least one frequency spectrum of light emitted from the first at least one illumination apparatus.

In some embodiments, the at least one parameter of the first at least one illumination apparatus comprises intensity of light emitted from the first at least one illumination apparatus.

In some embodiments, the method further comprises automatically transmitting information associated with the first at least one illumination apparatus in response to releasable connection of the first at least one illumination apparatus to a connection region of a support body.

In some embodiments, the information associated with the first at least one illumination apparatus comprises information identifying the first at least one illumination apparatus.

In some embodiments, the information associated with the first at least one illumination apparatus comprises information identifying at least one function of the first at least one illumination apparatus.

In some embodiments, the method further comprises automatically associating the first at least one illumination apparatus with a location of a connection region of a support body in response to releasable connection of the first at least one illumination apparatus to the connection region of the support body.

In some embodiments, the sensor apparatus is configured to configure at least one parameter of the sensor apparatus automatically in response to releasable connection of the sensor apparatus to a connection region of a support body.

In some embodiments, the method further comprises automatically transmitting information associated with the sensor apparatus in response to releasable connection of the sensor apparatus to a connection region of a support body.

In some embodiments, the information associated with the sensor apparatus comprises information identifying the sensor apparatus.

In some embodiments, the information associated with the sensor apparatus comprises information identifying at least one function of the sensor apparatus.

In some embodiments, the method further comprises automatically associating the sensor apparatus with a location of a connection region of a support body in response to releasable connection of the sensor apparatus to the connection region of the support body.

In some embodiments, each of the first at least one illumination apparatus comprises respective solid-state lighting.

In some embodiments, each of the first at least one illumination apparatus comprises a respective at least one LED.

In some embodiments, at least some of the light emitted from the first at least one illumination apparatus is directed to at least one plant.

According to another embodiment, there is provided a method of estimating a respective location of at least one of a plurality of interchangeable modules releasably connected to respective different connection regions of at least one support body, the method comprising: causing a first one of the plurality of interchangeable modules to transmit at least one optical signal; causing a second one of the plurality of interchangeable modules, spaced apart from the first one of the plurality of interchangeable modules, to measure the at least one optical signal; and causing at least one processor to estimate a respective location of one or both of the first and second ones of the plurality of interchangeable modules at least in response to the at least one optical signal and in response to measurement of the at least one optical signal at the second one of the plurality of interchangeable modules.

In some embodiments, the first and second ones of the plurality of interchangeable modules are releasably connected to a same support body.

In some embodiments, the first and second ones of the plurality of interchangeable modules are releasably connected to separate support bodies spaced apart from each other.

According to another embodiment, there is provided a module system comprising: at least one support body, each of the at least one support body comprising a plurality of connection regions; an illumination apparatus configured to emit light and configured to be connected releasably to the support body in at least one of the plurality of connection regions; and a sensor apparatus comprising at least one sensor; wherein the system is configured to control at least one characteristic of light emitted from the illumination apparatus in response to at least one measurement from the sensor apparatus.

In some embodiments, the sensor apparatus is configured to be connected releasably to the at least one support body in at least one of the plurality of connection regions.

In some embodiments, the at least one characteristic comprises at least one frequency spectrum of light emitted by the illumination apparatus.

In some embodiments, the at least one characteristic comprises an intensity of light emitted by the first at least one illumination apparatus.

In some embodiments, the at least one support body comprises a plurality of support bodies.

In some embodiments, the illumination apparatus is configured to be connected releasably to any one of the at least one support body in any one of the plurality of connection regions.

In some embodiments, the sensor apparatus is configured to be connected releasably to any one of the at least one support body in any one of the plurality of connection regions.

In some embodiments, a first at least one interchangeable module comprises the first at least one illumination apparatus and a second at least one interchangeable module comprises the sensor apparatus.

In some embodiments, a single interchangeable module comprises the first at least one illumination apparatus and the sensor apparatus.

In some embodiments, the system is configured to control at least one characteristic of light emitted from a single illumination apparatus in response to the at least one measurement from the sensor apparatus.

In some embodiments, the system is configured to control at least one characteristic of light emitted from a plurality of illumination apparatuses in response to the at least one measurement from the sensor apparatus.

In some embodiments, the system is configured to control at least one characteristic of light emitted from the illumination apparatus in response to at least one measurement from only the sensor apparatus.

In some embodiments, the system is configured to control at least one characteristic of light emitted from the illumination apparatus in response to at least one measurement from a plurality of sensor apparatuses comprising the sensor apparatus.

In some embodiments, the at least one measurement comprises a measurement of light.

In some embodiments, the at least one measurement comprises a measurement of temperature.

In some embodiments, the measurement of temperature comprises a measurement of temperature internal to the sensor apparatus.

In some embodiments, the measurement of temperature comprises a measurement of temperature external to the sensor apparatus.

In some embodiments, the illumination apparatus is configured to configure at least one parameter of the illumination apparatus automatically in response to releasable connection of the first at least one illumination apparatus to one of the plurality of connection regions.

In some embodiments, the at least one parameter of the apparatus comprises at least one frequency spectrum of light emitted from the illumination apparatus.

In some embodiments, the at least one parameter of illumination apparatus comprises intensity of light emitted from the illumination apparatus.

In some embodiments, the system is configured to transmit information associated with the first at least one illumination apparatus automatically in response to releasable connection of the first at least one illumination apparatus to a connection region of a support body.

In some embodiments, the information associated with the first at least one illumination apparatus comprises information identifying the first at least one illumination apparatus.

In some embodiments, the information associated with the first at least one illumination apparatus comprises information identifying at least one function of the first at least one illumination apparatus.

In some embodiments, the system is configured to associate the first at least one illumination apparatus with a location of a connection region of a support body automatically in response to releasable connection of the first at least one illumination apparatus to the connection region of the support body.

In some embodiments, the sensor apparatus is configured to configure at least one parameter of the sensor apparatus automatically in response to releasable connection of the sensor apparatus to one of the plurality of connection regions.

In some embodiments, the system is configured to transmit information associated with the sensor apparatus automatically in response to releasable connection of the sensor apparatus to a connection region of a support body.

In some embodiments, the information associated with the sensor apparatus comprises information identifying the sensor apparatus.

In some embodiments, the information associated with the sensor apparatus comprises information identifying at least one function of the sensor apparatus.

In some embodiments, the system is configured to associate the sensor apparatus with a location of a connection region of a support body automatically in response to releasable connection of the sensor apparatus to the connection region of the support body.

In some embodiments, the illumination apparatus comprises solid-state lighting.

In some embodiments, the illumination apparatus comprises at least one light-emitting diode ("LED").

According to another embodiment, there is provided a system comprising: at least one support body comprising a respective plurality of connection regions; a first interchangeable module configured to be connected releasably to at least one of the plurality of connection regions; and a second interchangeable module configured to be connected releasably to at least one of the plurality of connection regions. The system further comprises at least one processor configured to, at least: cause the first interchangeable module to transmit at least one optical signal when the first interchangeable module is connected releasably to a first one of the connection regions; cause the second interchangeable module to measure the at least one optical signal when the second interchangeable module is connected releasably to a second one of the connection regions spaced apart from the first one of the connection regions; and estimate a respective location of one or both of the first and second interchangeable modules at least in response to the at least one optical signal and in response to measurement of the at least one optical signal at the second interchangeable module.

According to another embodiment, there is provided use of the system for growing at least one plant.

According to another embodiment, there is provided a module system comprising: a support body comprising a plurality of connection regions; and a plurality of illumination apparatuses; wherein a first one of the plurality of illumination apparatuses is configured to emit light according to a first at least one characteristic and is configured to be connected releasably to the support body in at least one of the plurality of connection regions; and wherein a second one of the plurality of illumination apparatuses is configured to emit light according to a second at least one characteristic different from the first at least one characteristic and is configured to be connected releasably to the support body in at least one of the plurality of connection regions.

In some embodiments, the first one of the plurality of illumination apparatuses is configured to be connected releasably to the support body in any one of the plurality of connection regions.

In some embodiments, the second one of the plurality of illumination apparatuses is configured to be connected releasably to the support body in any one of the plurality of connection regions.

In some embodiments, each of the plurality of illumination apparatuses is configured to be connected releasably to the support body in any one of the plurality of connection regions.

In some embodiments, each of the plurality of illumination apparatuses comprises respective solid-state lighting.

In some embodiments, each of the plurality of illumination apparatuses comprises a respective at least one LED.

In some embodiments, the first one of the plurality of illumination apparatuses is configured to emit light of a first at least one frequency spectrum, and the second one of the plurality of illumination apparatuses is configured to emit light of a second at least one frequency spectrum different from the first at least one frequency spectrum.

In some embodiments, the first one of the plurality of illumination apparatuses is configured to emit light at a first intensity, and the second one of the plurality of illumination apparatuses is configured to emit light at a second intensity different from the first intensity.

In some embodiments, at least one of the plurality of illumination apparatuses is configured to configure at least one parameter of the at least one of the plurality of illumination apparatuses automatically in response to releasable connection of the at least one of the plurality of illumination apparatuses to the support body in at least one of the plurality of connection regions.

In some embodiments, the at least one parameter of the at least one of the plurality of illumination apparatuses comprises at least one frequency spectrum of light emitted from the at least one of the plurality of illumination apparatuses.

In some embodiments, the at least one parameter of the at least one of the plurality of illumination apparatuses comprises intensity of light emitted from the at least one of the plurality of illumination apparatuses.

In some embodiments, the system further comprises a sensor apparatus comprising at least one sensor and configured to be connected releasably to the support body in at least one of the plurality of connection regions.

According to another embodiment, there is provided a module system comprising: a support body comprising a plurality of connection regions; an illumination apparatus configured to emit light and configured to be connected releasably to the support body in at least one of the plurality of connection regions; and a sensor apparatus comprising at least one sensor and configured to be connected releasably to the support body in at least one of the plurality of connection regions.

In some embodiments, the illumination apparatus is configured to be connected releasably to the support body in any one of the plurality of connection regions.

In some embodiments, the illumination apparatus comprises solid-state lighting.

In some embodiments, the solid-state lighting comprises at least one LED.

In some embodiments, the illumination apparatus is configured to configure at least one parameter of the illumination apparatus automatically in response to releasable connection of the illumination apparatus to the support body in the at least one of the plurality of connection regions.

In some embodiments, the at least one parameter of the at least one of the plurality of illumination apparatuses comprises at least one frequency spectrum of light emitted from the at least one of the plurality of illumination apparatuses.

In some embodiments, the at least one parameter of the at least one of the plurality of illumination apparatuses comprises intensity of light emitted from the at least one of the plurality of illumination apparatuses.

In some embodiments, the sensor apparatus is configured to be connected releasably to the support body in any one of the plurality of connection regions.

In some embodiments, the sensor apparatus comprises a light sensor configured to sense light.

In some embodiments, the sensor apparatus comprises at least one plant growth sensor configured to sense plant growth.

In some embodiments, the at least one plant growth sensor comprises a plant height sensor.

In some embodiments, the at least one plant growth sensor comprises a reflectance sensor.

In some embodiments, the at least one plant growth sensor comprises a fluorescence sensor.

In some embodiments, the at least one plant growth sensor comprises a camera.

In some embodiments, the sensor apparatus comprises an optical reflectance sensor configured to sense optical reflectance.

In some embodiments, the sensor apparatus comprises a humidity sensor configured to sense humidity.

In some embodiments, the sensor apparatus comprises a temperature sensor configured to sense temperature.

In some embodiments, the temperature sensor is configured to sense leaf temperature.

In some embodiments, the temperature sensor is configured to sense ambient temperature.

In some embodiments, the sensor apparatus comprises a carbon dioxide concentration sensor configured to sense carbon dioxide concentration.

In some embodiments, the sensor apparatus is configured to configure at least one parameter of the sensor apparatus automatically in response to releasable connection of the sensor apparatus to the support body in at least one of the plurality of connection regions.

According to another embodiment, there is provided use of the system for growing at least one plant.

According to another embodiment, there is provided a method of varying at least one characteristic of light emitted from a module system comprising a support body comprising a plurality of connection regions and comprising a first illumination apparatus configured to emit light according to a first at least one characteristic and releasably connected to a first one of the plurality of connection regions, the method comprising releasably connecting a second illumination apparatus to a second one of the plurality of connection regions, wherein the second illumination apparatus is configured to emit light according to a second at least one characteristic different from the first at least one characteristic.

In some embodiments, the first illumination apparatus comprises solid-state lighting.

In some embodiments, the first illumination apparatus comprises a first at least one LED.

In some embodiments, the second illumination apparatus comprises a second at least one LED.

In some embodiments, at least some of the light emitted from the module system is directed to at least one plant.

In some embodiments, the first illumination apparatus is configured to emit light at a first at least one frequency, and the second one of the plurality of illumination apparatuses is configured to emit light at a second at least one frequency different from the first at least one frequency.

In some embodiments, the first illumination apparatus is configured to emit light at a first intensity, and the second illumination apparatus is configured to emit light at a second intensity different from the first intensity.

Other aspects and features will become apparent to those ordinarily skilled in the art upon review of the following description of illustrative embodiments in conjunction with the accompanying figures.

DETAILED DESCRIPTION

Figure 1:
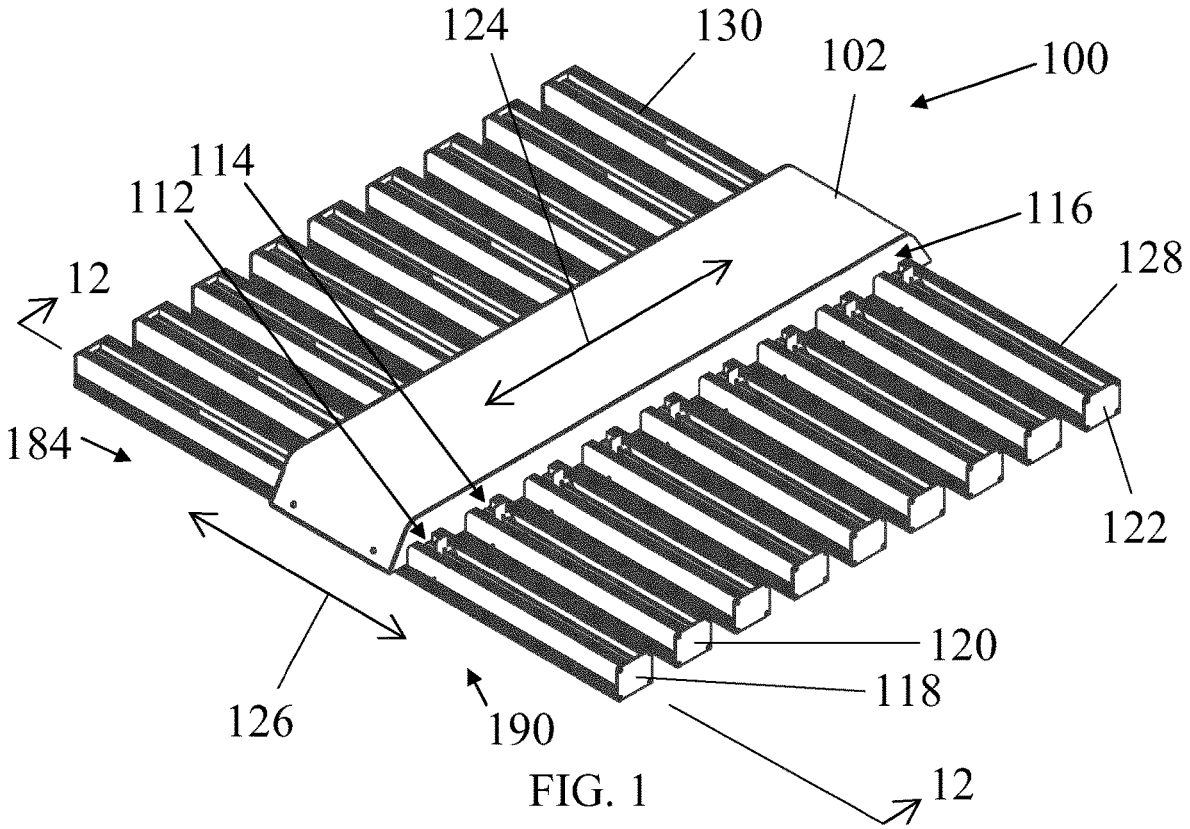
FIG. 1 is an isometric view of a module system according to one embodiment.

Referring to FIG. 1, a module system according to one embodiment is shown generally at 100 and includes a support body 102. In general, a module system described herein may also be referred to as an illumination system or as a fixture system, and a support body described herein may also act as and be referred to as a fixture housing, although the support body may also only act as a support and be separate from a fixture housing.

Support Bodies

In the embodiment shown, the support body 102 may be supported from a ceiling by support cables, but support bodies in other embodiments may be suspended or otherwise supported in other ways, and may be suspended from or supported by other structures. For example, support bodies in other embodiments may supported on a bottom side of a shelf and exposed to a shelf below.

Support bodies such as those described herein may be constructed with a degree of protection against ingress of particles or liquids, and may for example be enclosed and resistant to liquid ingress to a certain standard, such as an ingress protection ("IP") standard such as IP65 or IP67. Additionally or alternatively, internal components of support bodies such as those described herein may be constructed with a degree of protection against ingress of particles or liquids, and may for example be enclosed and resistant to liquid ingress to a certain standard, such as an IP standard such as IP65 or IP67.

Further, support bodies such as those described herein may include one or more components for power conversion, regulation, control, or adjustment (such as a power supply, for example) and power distribution (such as a wiring harness, for example) for one or more interchangeable modules such as those described herein. In some embodiments, for example, electrical power input may range from about 90 volts ("V") of alternating current ("AC") to about 600 V AC, and electrical power output may range from about 10 watts ("W") of direct current ("DC") to about 10,000 W DC. Additionally or alternatively, support bodies such as those described herein may include one or more components for network communication management and distribution, such as a network switch or a network router as described below, for example.

Further, in general, support bodies such as those described herein may be used to enclose or otherwise protect cables for transmission of power or for communication, for example.

Connection Regions of Support Bodies

The support body 102 defines nine connection regions such as, for example, connection regions shown generally at 112, 114, and 116 in FIG. 1. However, alternative embodiments may define more or fewer connection regions. In general, some of all of the connection regions of a support body may be configured to connect releasably to one or more interchangeable modules such as those described herein, for example. In general, an interchangeable module described herein may also be referred to as an active subsystem, and one or more interchangeable modules releasably connected to a support body may be referred to as one or more distinct subsystems of a module system. Such subsystems may vary in many different ways as described herein, for example. Further, in general, support bodies such as those described herein may act as means of hanging or mounting one or more interchangeable modules such as those described herein.

In the embodiment of FIG. 1, each of the nine connection regions of the support body 102 is releasably connected to one respective interchangeable module and, for example, the connection region 112 is releasably connected to an interchangeable module 118, the connection region 114 is releasably connected to an interchangeable module 120, and the connection region 116 is releasably connected to an interchangeable module 122.

Also, in the embodiment of FIG. 1, the support body 102 is elongate and has a length in a longitudinal direction 124 relative to the support body 102, and the interchangeable modules are also elongate and releasably connected to respective connecting regions of the support body 102 such that lengths of the interchangeable modules extend generally horizontally, generally in a transverse direction 126 relative to the support body 102, and generally perpendicular to the direction 124. However, alternative embodiments may vary, such as alternative embodiments described below, for example.

Also, in the embodiment of FIG. 1, the interchangeable modules are releasably connected to respective connecting regions of the support body 102 generally at longitudinal centers of the interchangeable modules such that portions of the interchangeable modules that extend generally transversely to the support body 102 on opposite sides of the support body 102 are generally equal in length. For example, a portion 128 of the interchangeable module 122 extending generally transversely to the support body 102 on one side of the support body 102 has a length that is generally equal to a length of a portion 130 of the interchangeable module 122 extending generally transversely to the support body 102 on an opposite side of the support body 102. In general, the interchangeable modules in the embodiment of FIG. 1 may be described as in-plane regularly distributed interchangeable modules, but alternative embodiments may vary and may have different geometric configurations such as different geometric configurations described below, for example.

Figure 2:
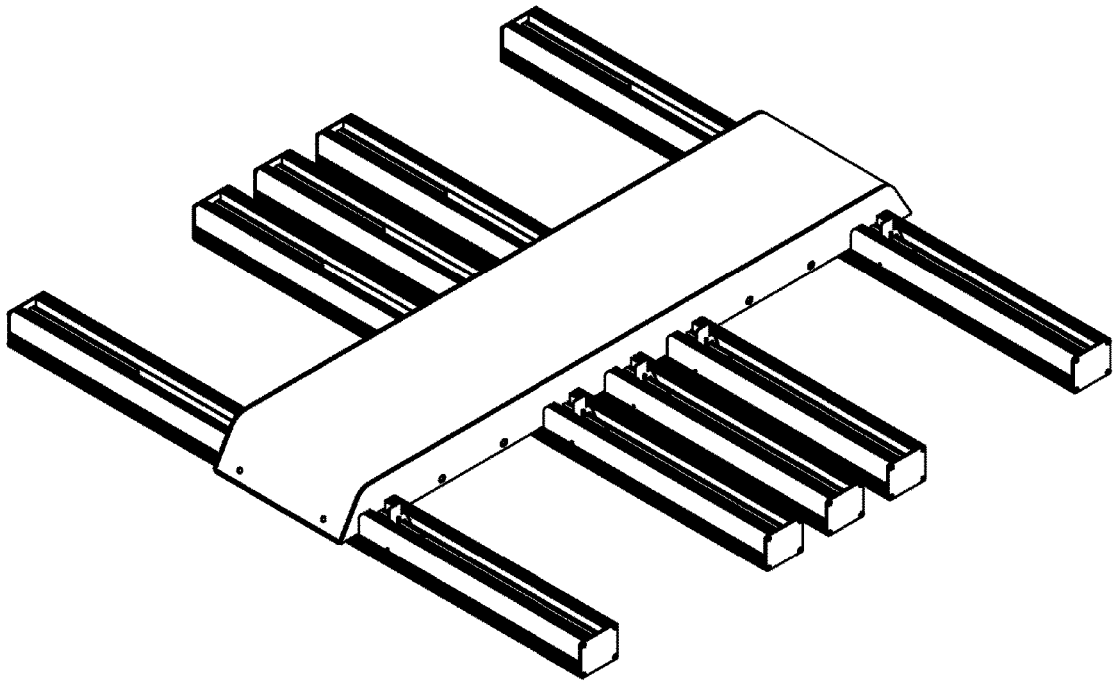
FIG. 2 is an isometric view of a module system according to another embodiment.

Referring to FIG. 2, a module system according to another embodiment includes a support body that may be similar to the support body 102 (shown in FIG. 1), but in the embodiment of FIG. 2, only five of the nine connection regions are releasably connected to respective interchangeable modules (which may be similar to the interchangeable modules of FIG. 1). Further, the five interchangeable modules of FIG. 2 are spaced apart from each other in an uneven but symmetric way that may be suitable for one or more particular applications. In general, the interchangeable modules in the embodiment of FIG. 2 may be described as in-plane symmetrically distributed interchangeable modules, but alternative embodiments may vary and may have different geometric configurations.

Figure 3:
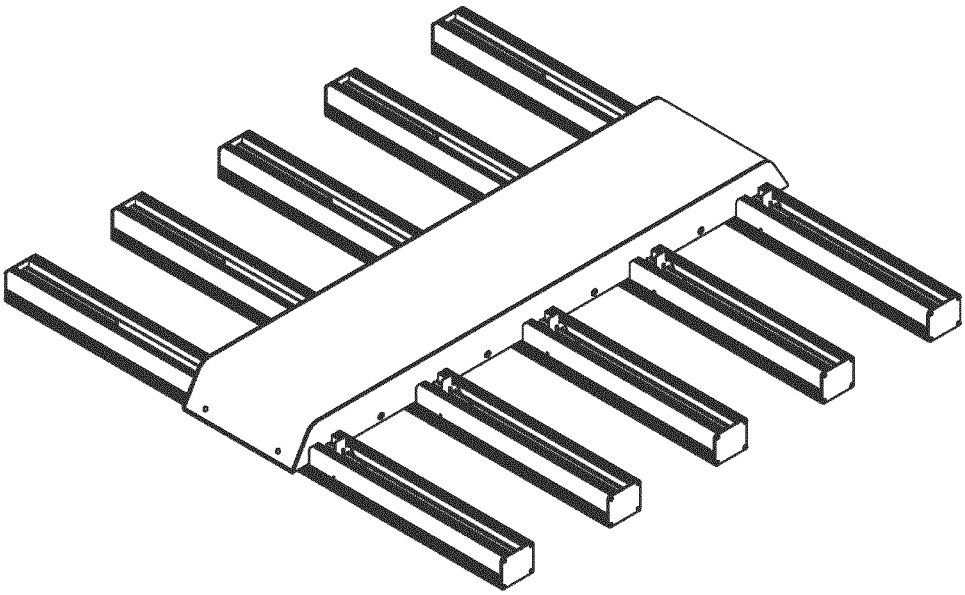
FIG. 3 is an isometric view of a module system according to another embodiment.

Referring to FIG. 3, a module system according to another embodiment includes a support body that may be similar to the support body 102 (shown in FIG. 1), but again in the embodiment of FIG. 3, only five of the nine connection regions are releasably connected to respective interchangeable modules (which may be similar to the interchangeable modules of FIG. 1). However, the five interchangeable modules of FIG. 3 are spaced apart from each other in an even and symmetric way that may be suitable for one or more particular applications. In general, the interchangeable modules in the embodiment of FIG. 3 may be described as in-plane symmetrically distributed interchangeable modules, but alternative embodiments may vary and may have different geometric configurations.

Figure 4:
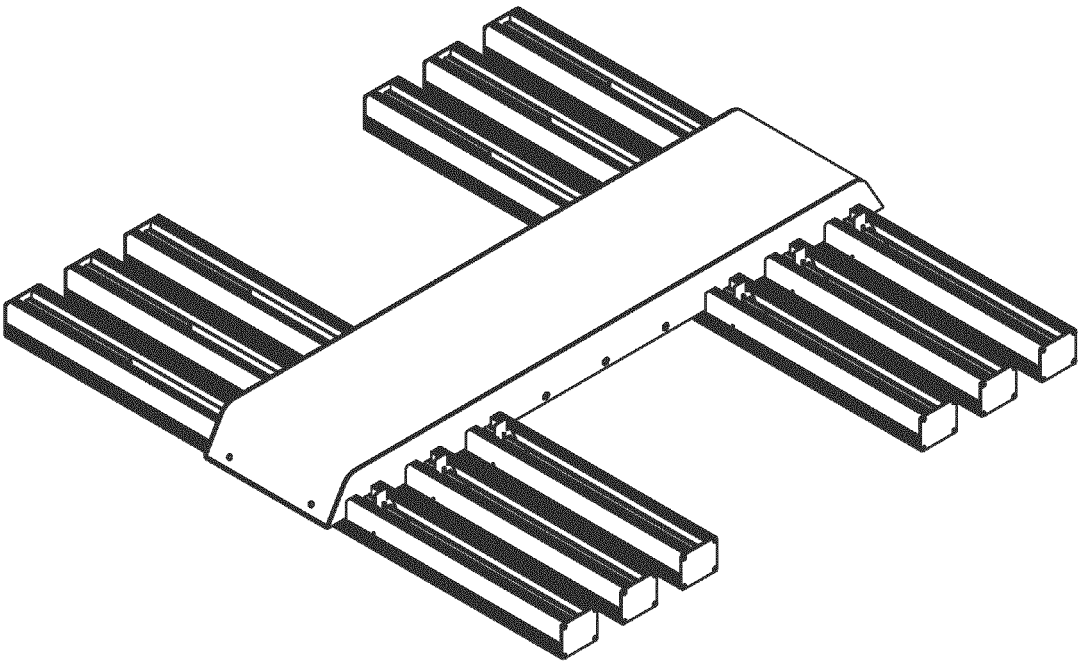
FIG. 4 is an isometric view of a module system according to another embodiment.

Referring to FIG. 4, a module system according to another embodiment includes a support body that may be similar to the support body 102 (shown in FIG. 1), but in the embodiment of FIG. 4, only six of the nine connection regions are releasably connected to respective interchangeable modules (which may be similar to the interchangeable modules of FIG. 1). The six interchangeable modules of FIG. 4 are spaced apart from each other in a clustered and symmetric way that may be suitable for one or more particular applications. In general, the interchangeable modules in the embodiment of FIG. 4 may be described as in-plane clustered and symmetrically distributed interchangeable modules, but alternative embodiments may vary and may have different geometric configurations. Further, in general, in embodiments such as those described herein, interchangeable modules may be clustered, may not be clustered, or may be a combination of both clustered and non-clustered.

Figure 5:
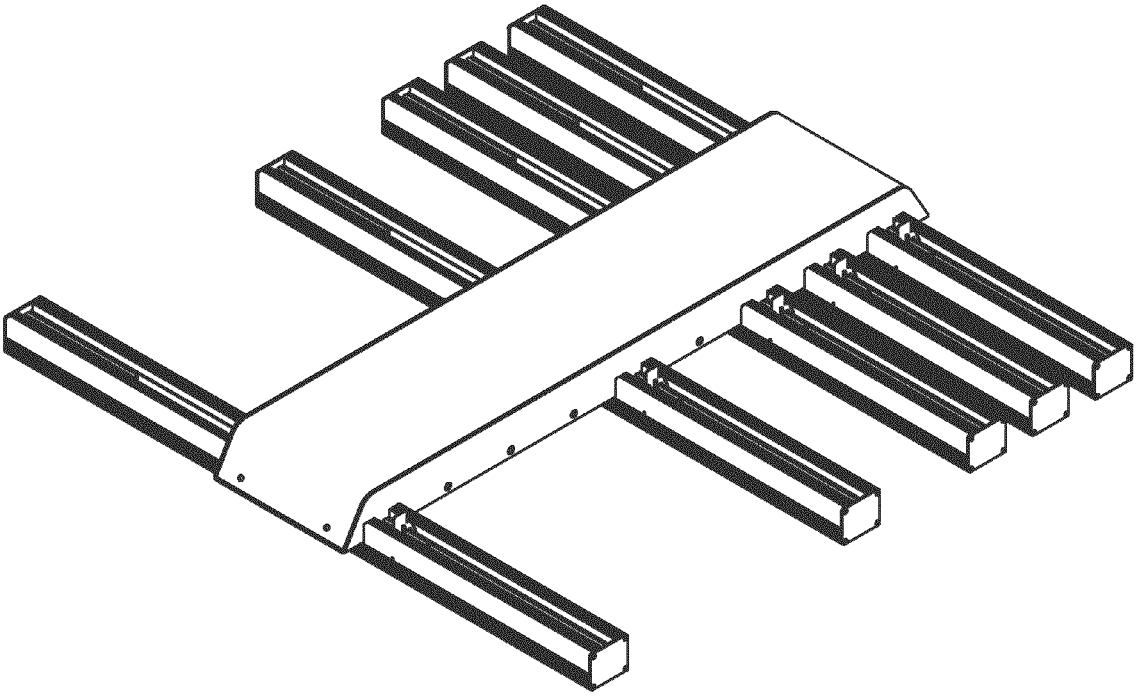
FIG. 5 is an isometric view of a module system according to another embodiment.

Referring to FIG. 5, a module system according to another embodiment includes a support body that may be similar to the support body 102 (shown in FIG. 1), but in the embodiment of FIG. 5, only five of the nine connection regions are releasably connected to respective interchangeable modules (which may be similar to the interchangeable modules of FIG. 1). Further, the five interchangeable modules of FIG. 5 are spaced apart from each other in an uneven but asymmetric way that differs from the spacing of FIG. 2 and that may be suitable for one or more particular applications that may be different from the one or more particular applications of FIG. 2. In general, the interchangeable modules in the embodiment of FIG. 5 may be described as in-plane asymmetrically distributed interchangeable modules, but alternative embodiments may vary and may have different geometric configurations. In general, in embodiments such as those described herein, interchangeable modules may be symmetrically distributed or asymmetrically distributed.

Figure 6:
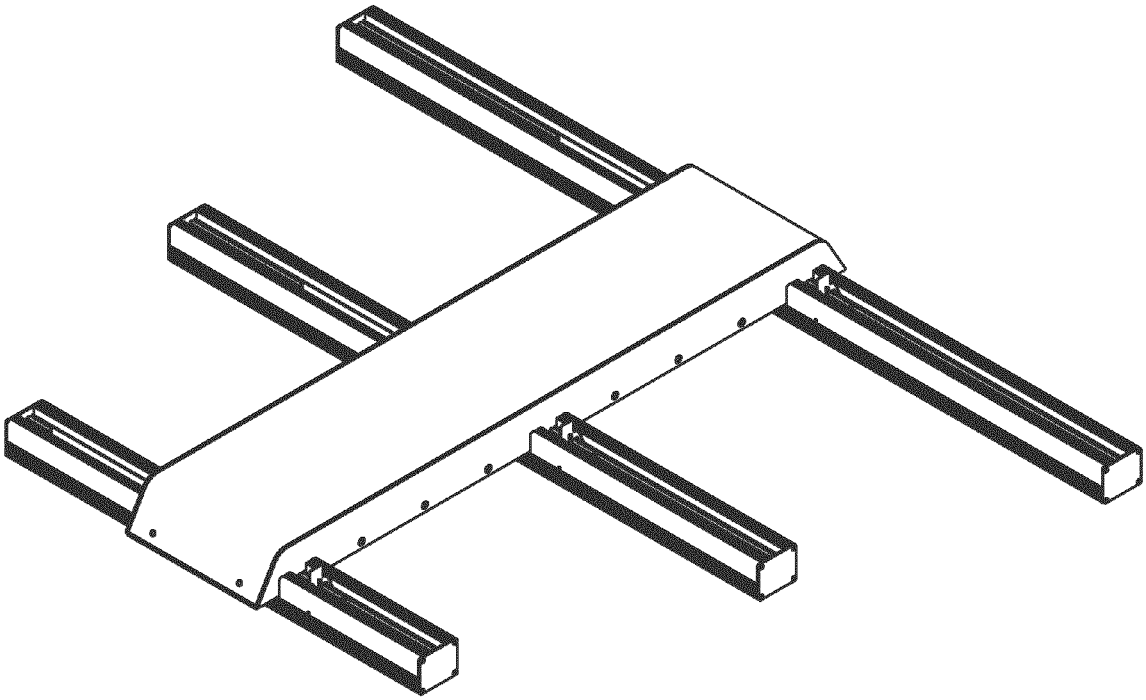
FIG. 6 is an isometric view of a module system according to another embodiment.

Referring to FIG. 6, a module system according to another embodiment includes a support body that may be similar to the support body 102 (shown in FIG. 1), and in the embodiment of FIG. 6, three connection regions are releasably connected to respective interchangeable modules (which may be similar to the interchangeable modules of FIG. 1). Further, the three interchangeable modules of FIG. 6 have different lengths. In general, in embodiments such as those described herein, interchangeable modules may have the same or different lengths.

Figure 7:
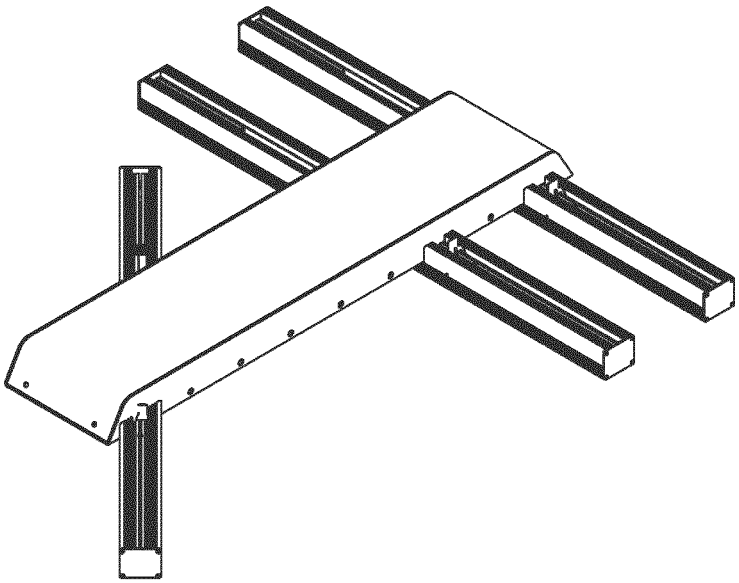
FIG. 7 is an isometric view of a module system according to another embodiment.

Referring to FIG. 7, a module system according to another embodiment includes a support body that may be similar to the support body 102 (shown in FIG. 1), and in the embodiment of FIG. 7, three connection regions are releasably connected to respective interchangeable modules (which may be similar to the interchangeable modules of FIG. 1). Further, two of the interchangeable modules of FIG. 7 are parallel to each other, whereas the third of the interchangeable modules of FIG. 7 is non-parallel (or oblique) to the other two.

In general, in embodiments such as those described herein, interchangeable modules may be parallel to each other, non-parallel (or oblique) to each other, or a combination of parallel to each other and non-parallel (or oblique) to each other (as shown in FIG. 7, for example). Further, in general, in embodiments such as those described herein, interchangeable modules may extend perpendicular to a longitudinal direction relative to a support body, non-perpendicular (or oblique) to the longitudinal direction relative to the support body, or in a combination of perpendicular and non-perpendicular (or oblique) to the longitudinal direction relative to the support body (as shown in FIG. 7, for example).

Figure 8:
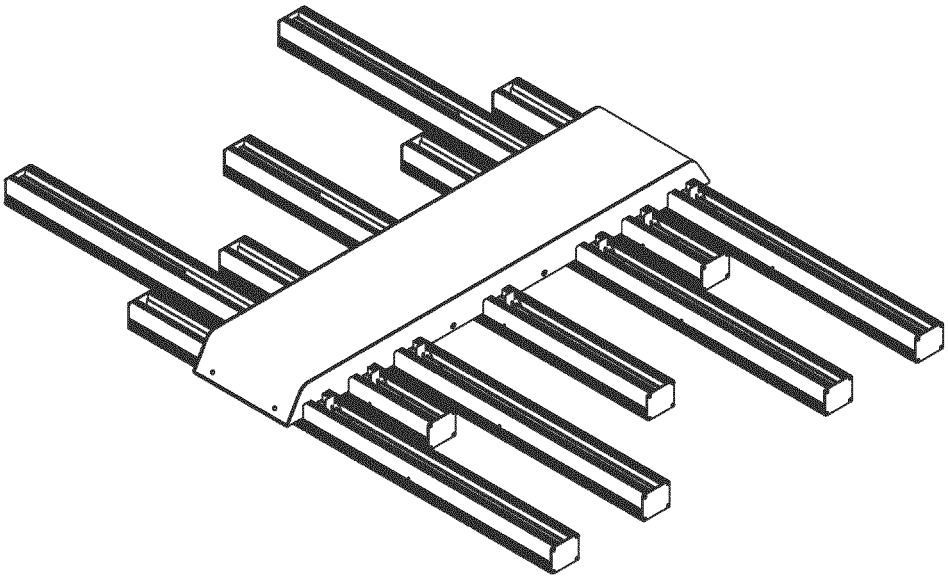
FIG. 8 is an isometric view of a module system according to another embodiment.

Referring to FIG. 8, a module system according to another embodiment includes a support body that may be similar to the support body 102 (shown in FIG. 1), and in the embodiment of FIG. 8, seven connection regions are releasably connected to respective interchangeable modules (which may be similar to the interchangeable modules of FIG. 1). However, in the embodiment of FIG. 8, some of the interchangeable modules are not centered transversely relative to the support body and therefore extend transversely relative to the support body by different lengths on opposite sides of the support body. In general, in embodiments such as those described herein, interchangeable modules may be centered transversely relative to a support body, not centered transversely relative to the support body, or a combination of centered and not centered transversely relative to the support body.

In the embodiments of FIG. 2 to FIG. 8, the interchangeable modules may be connected to the support body as in the embodiment of FIG. 1, in that the interchangeable modules of FIG. 2 and of FIG. 5 extend generally horizontally, generally in a transverse direction relative to a longitudinal direction relative to the support body, and generally perpendicular to the longitudinal direction. Again, however, alternative embodiments may vary, such as alternative embodiments described below, for example.

Figure 9:
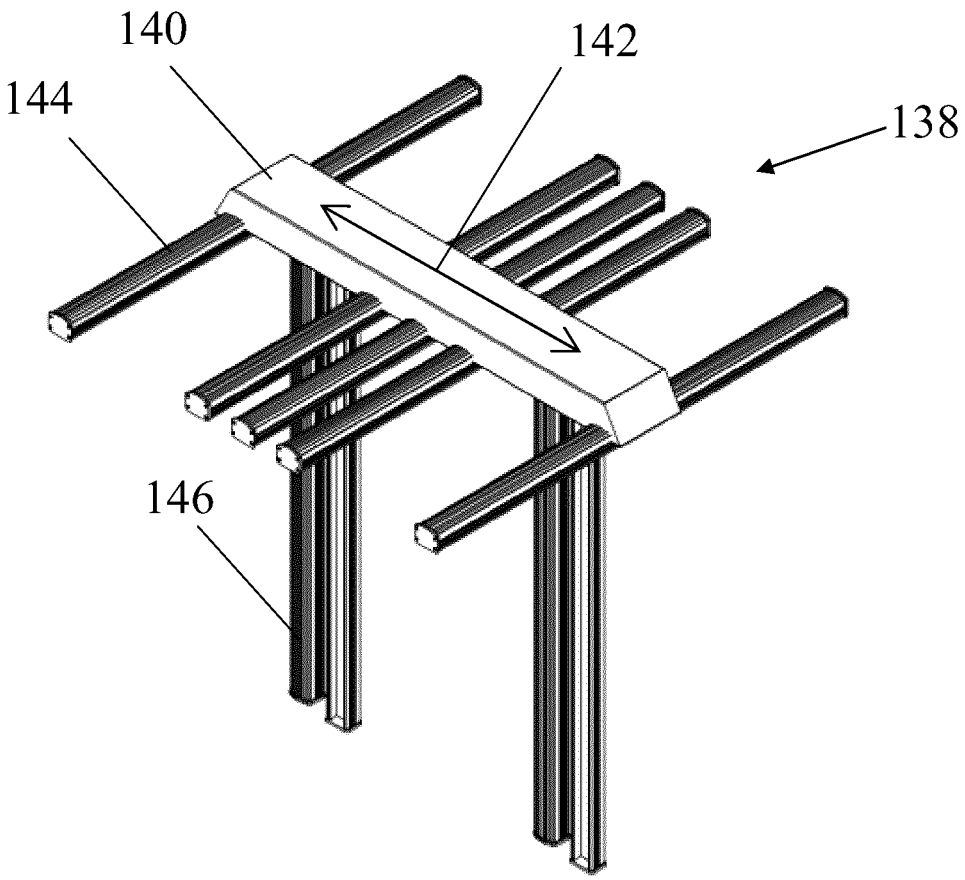
FIG. 9 is an isometric view of a module system according to another embodiment.

Referring to FIG. 9, a module system according to another embodiment is shown generally at 138 and includes a support body 140 that may be similar to the support body 102 (shown in FIG. 1). The support body 140 also includes nine connection regions that may be similar to the connection regions of the support body 102, but again alternative embodiments may define more or fewer connection regions. However, in the embodiment of FIG. 9, five interchangeable modules (including the interchangeable module 144, for example) are connected to respective connection regions of the such that, as in the embodiment of FIG. 1, those five interchangeable modules extend generally horizontally, generally in a transverse direction relative to a longitudinal direction 142 relative to the support body 140, and generally perpendicular to the longitudinal direction 142.

However, in the embodiment of FIG. 9, four interchangeable modules (including the interchangeable module 146, for example) are releasably connected to respective connection regions of the such that those four interchangeable modules extend generally vertically and generally perpendicular to the longitudinal direction 142. Further, those four interchangeable modules are releasably connected to respective connection regions at respective ends of the interchangeable modules such that generally an entire length of the interchangeable modules extends away from the support body 140.

In general, the interchangeable modules in the embodiment of FIG. 9 may be described as combined in-plane and out-of-plane interchangeable modules, but alternative embodiments may vary and may have different geometric configurations. In general, in embodiments such as those described herein, interchangeable modules may be coplanar, may not be coplanar, or may be a combination of both coplanar and non-coplanar (as shown in FIG. 9, for example).

Figure 10:
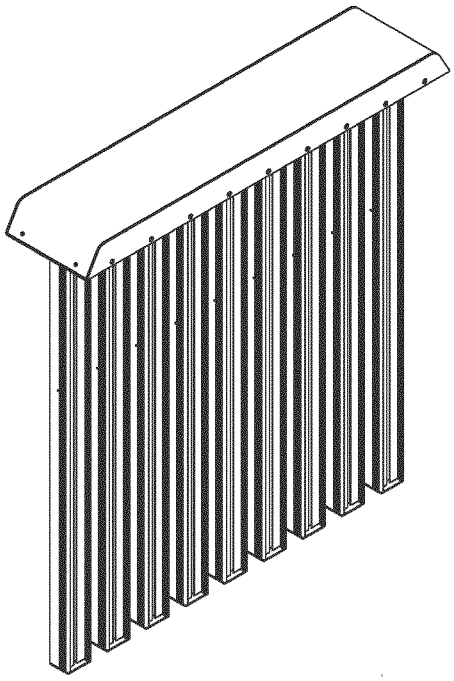
FIG. 10 is an isometric view of a module system according to another embodiment.

Referring to FIG. 10, a module system according to another embodiment includes a support body that may be similar to the support body 102 (shown in FIG. 1), and in the embodiment of FIG. 10, all of the connection regions are releasably connected to respective interchangeable modules (which may be similar to the interchangeable modules of FIG. 1). However, in the embodiment of FIG. 10, all of the interchangeable modules extend generally vertically and generally perpendicular to a longitudinal direction relative to the support body.

Figure 11:
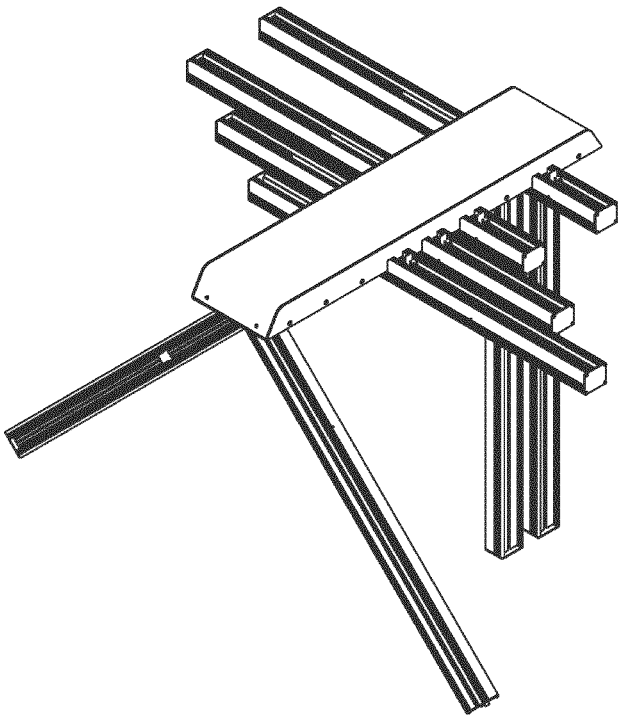
FIG. 11 is an isometric view of a module system according to another embodiment.

Referring to FIG. 11, a module system according to another embodiment includes a support body that may be similar to the support body 102 (shown in FIG. 1), and in the embodiment of FIG. 11, some connection regions are releasably connected to respective interchangeable modules (which may be similar to the interchangeable modules of FIG. 1). However, in the embodiment of FIG. 11, some of the interchangeable modules extend generally horizontally, some of the interchangeable modules extend generally vertically, and some of the interchangeable modules extend neither generally horizontally nor generally vertically, but rather extend obliquely to horizontal and vertical planes.

In general, in embodiments such as those described herein, interchangeable modules may extend generally horizontally, generally vertically, neither generally horizontally nor generally vertically (or, in other words, oblique to one or both of horizontal and vertical planes), or in a combination of two or more thereof (as shown in FIG. 11, for example).

In embodiments of FIG. 1 to FIG. 11, references to horizontal and vertical are references to the orientations shown in the drawings, and alternative embodiments may vary, for example by supporting support bodies in other orientations or releasably connecting interchangeable modules to a support body in other orientations or positions relative to the support body. For example, if the support body 140 is in an orientation other than the orientation shown in FIG. 9, then the interchangeable module 146 may be cantilevered by the support body 140. As a result, the interchangeable module 146 may generally be referred to as depending from, or cantilevered by, the support body 140.

The embodiments shown include a fixed number of connection regions. However, alternative embodiments may include a continuous connection, such as rail or a guide, for example. In such embodiments, one or more interchangeable modules may be mounted and slid to a large or infinite number of connection regions.

Other Components of Support Bodies

Support bodies such as those described herein may include one or more components for providing power to any interchangeable modules that are releasably connected to the support bodies. For example, connection regions of support bodies such as those described herein may include one or more power transmission interfaces positioned so that one or more power transmission interfaces on the support bodies may connect with one or more complementary power transmission interface on an interchangeable module in response to releasably connecting the interchangeable module to the connection region of the support body.

Further, support bodies such as those described herein may include one or more components for providing communication between the support bodies and any interchangeable modules that are releasably connected to the support bodies. For example, connection regions of support bodies such as those described herein may include communication interfaces (such as category 6 Ethernet™ interfaces, for example) configured to transmit, to receive, or to transmit and receive one or more communication signals for communication, and positioned so that one or more communication interfaces on the support bodies may connect with one or more complementary communication interface on an interchangeable module in response to releasably connecting the interchangeable module to the connection region of the support body. Alternative embodiments may include components for wireless communication, or other alternatives to category 6 Ethernet™ interfaces.

Further, support bodies such as those described herein may include one or more components for network connection, for example for communication between a central control and any interchangeable modules that are releasably connected to the support bodies, as described below for example. Support bodies such as those described herein may also include one or more components for facilitating communication between such a central control and other support bodies, for example by providing for daisy-chain communication between such a central control and a plurality of support bodies. Such network communication components may facilitate wired or wireless communication, for example.

Interchangeable Modules

In general, an interchangeable module as described herein may be an illumination apparatus, may be a sensor apparatus, or may be both an illumination apparatus and a sensor apparatus, and may include one or more other components. Herein, reference to an illumination apparatus may include reference to an interchangeable module that is both an illumination apparatus and a sensor apparatus or more generally that may include functionality in addition to functionality as an illumination apparatus, and reference to a sensor apparatus may include reference to an interchangeable module that is both an illumination apparatus and a sensor apparatus or more generally that may include functionality in addition to functionality as a sensor apparatus. Accordingly, an interchangeable module as described herein may be a module capable of interacting directly with one or more plants by providing input (such as light emission, for example), by sensing, or by both. Also, in general, an illumination apparatus described herein may also be referred to as a light bar, and a sensor apparatus described herein may also be referred to as a sensor bar or sensing bar.

In general, interchangeable modules such as those described herein may be constructed with a degree of protection against ingress of particles or liquids, and may for example be enclosed and resistant to liquid ingress to a certain standard, such as an IP standard such as IP65 or IP67. Further, interchangeable modules such as those described herein may be configured for heat dissipation, such as active heat dissipation, passive heat dissipation, or a combination thereof, for example.

Also, in general, an interchangeable module as described herein may include one or more power transmission interfaces for receiving power, one or more communication interfaces configured to transmit, to receive, or to transmit and receive one or more signals for communication, or for both one or more power transmission interfaces and one or more communication interfaces, for example. Further, such one or more interfaces on an interchangeable module may be positioned on the interchangeable module so that the one or more interfaces on the interchangeable module may connect with a respective one or more complementary interfaces in the connection region of a support body in response to releasably connecting the interchangeable module to the connection region of the support body. In other words, by releasably connecting an interchangeable module to a connection region of a support body, the interchangeable module may simultaneously be connected to the support body for receiving power from the support body, for communication to or through the support body, or for both. Such communication interfaces may facilitate wired or wireless communication, for example.

In some embodiments, an interchangeable module as described herein may be releasably connectable to a connection region of a support body using a "quick connect" connection that may connect and disconnect an interchangeable module to a connection region of a support body by movement of the interchangeable module relative to the support body, by operation of a releasable latch, or otherwise in a manner that may not require additional tools or components.

Figure 12:
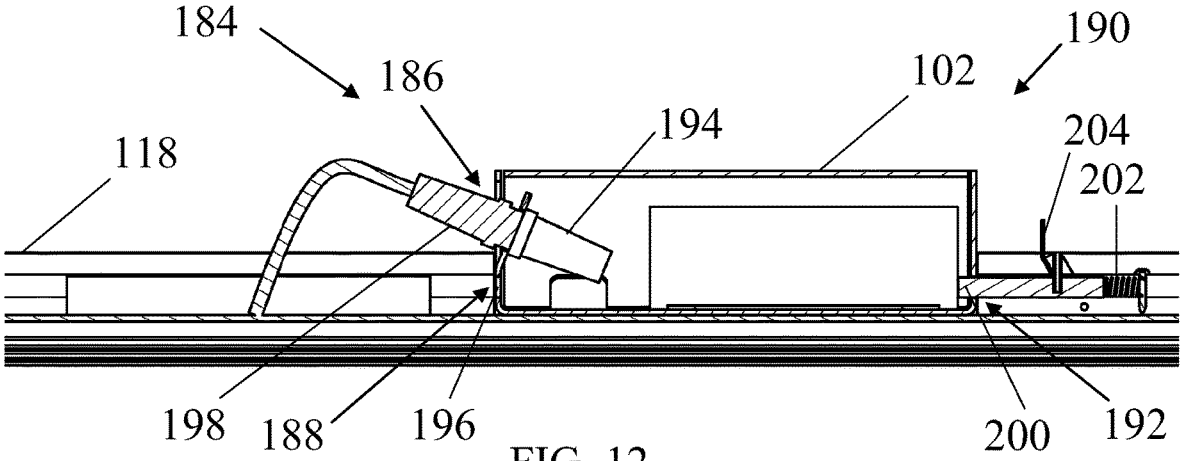
FIG. 12 is a cross-sectional view, taken along the line 12-12 in FIG. 1, of an interchangeable module releasably connected to a connection region of the support body of FIG. 1, using a "quick connect" connection according to another embodiment.
Figure 13:
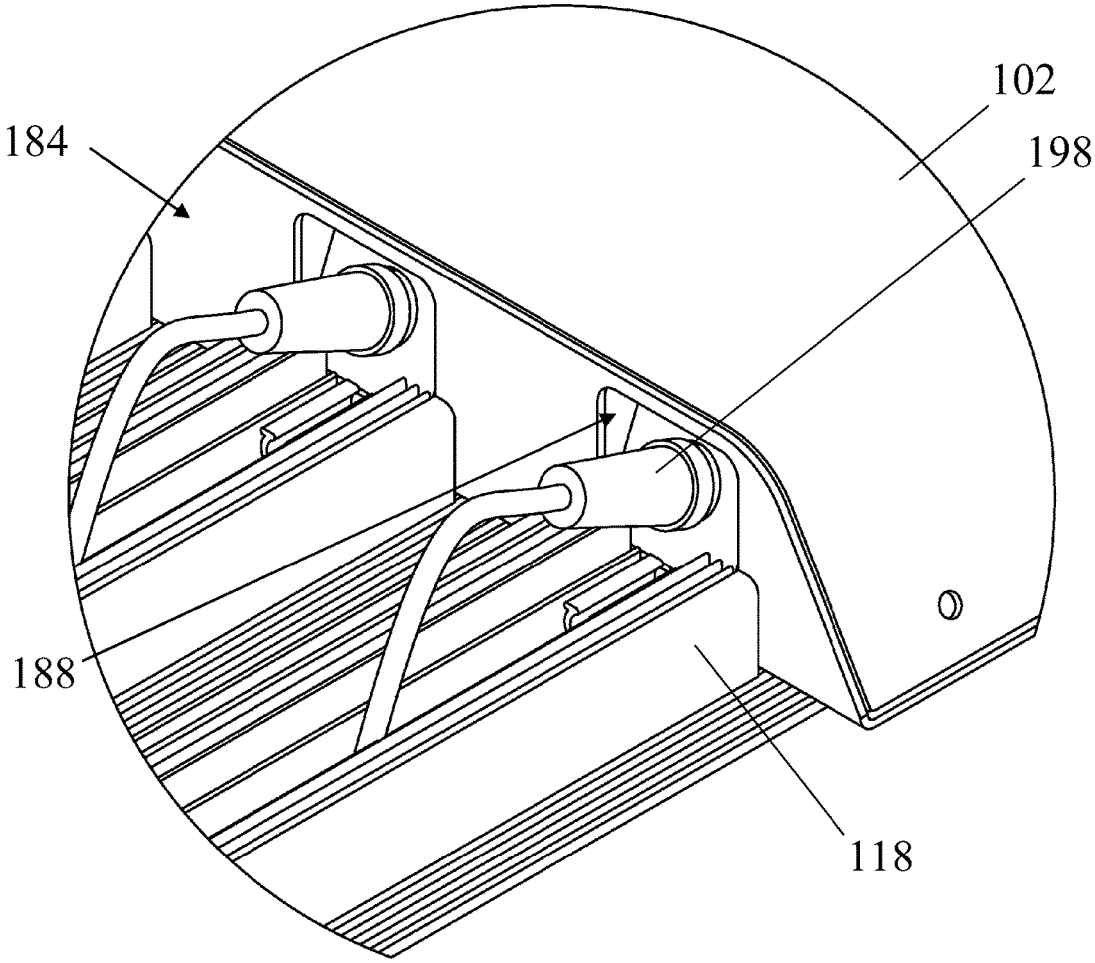
FIG. 13 is an isometric view from a left-hand side of the interchangeable module and the support body of FIG. 12.
Figure 14:
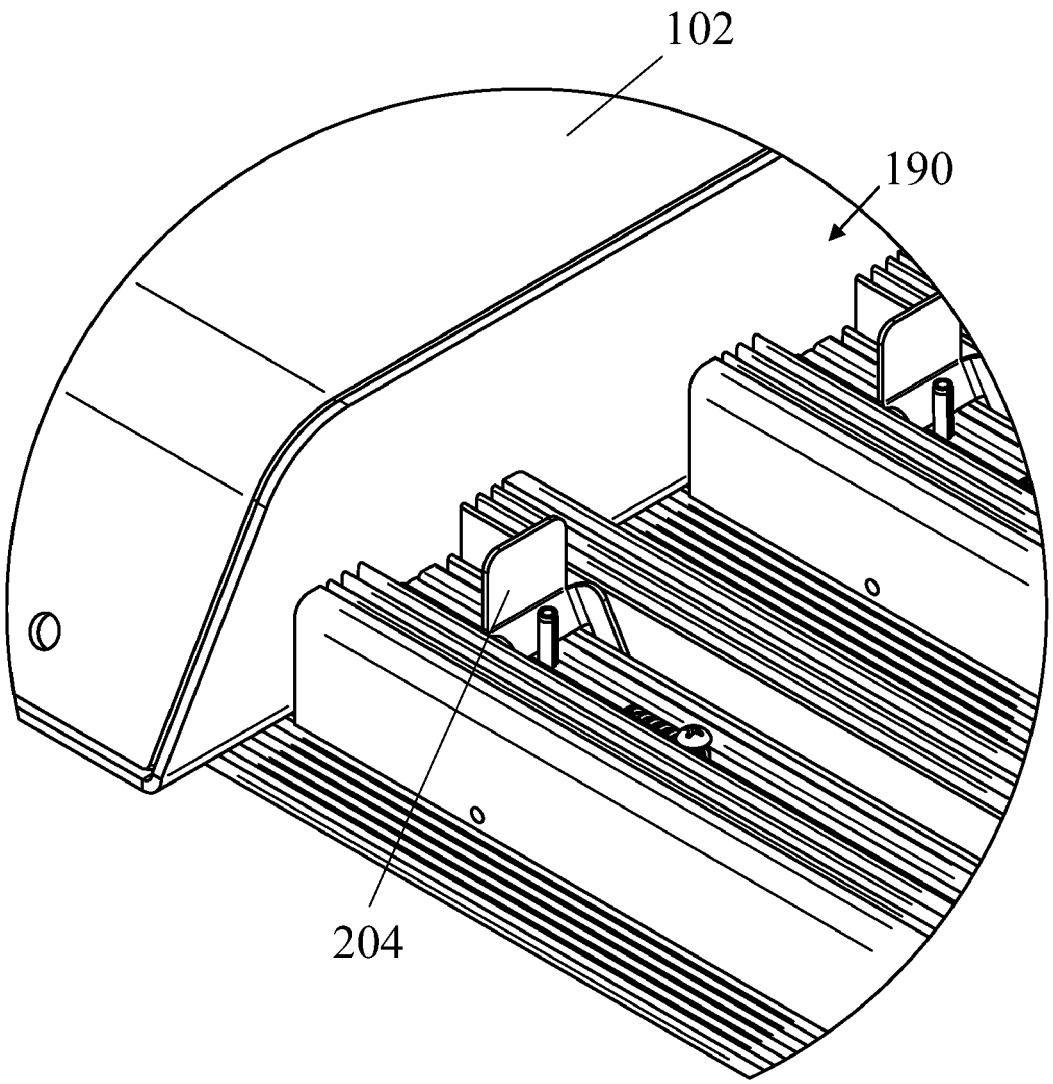
FIG. 14 is an isometric view from a right-hand side of the interchangeable module and the support body of FIG. 12.

For example, FIG. 12 to FIG. 14 illustrate a "quick connect" connection according to one embodiment. In the embodiment shown, on a first side of the support body 102 shown generally at 184, the support body 102 includes an electrical interface opening shown generally at 186 and a first retainer opening shown generally at 188. Further, in the embodiment shown, on a second side of the support body 102 shown generally at 190 and opposite the first side 184, the support body 102 includes a second retainer opening shown generally at 192. The support body 102 also includes a first electrical interface 194 inside the support body 102 and facing the electrical interface opening 186.

The interchangeable module 118 includes a retainer projection 196 sized to be received at least partially in the first retainer opening 188 as shown in FIG. 12. The interchangeable module 118 also includes a second electrical interface 198 that is complementary to the first electrical interface 194 and that is positioned to be connectable to the first electrical interface 194 when the retainer projection 196 is received at least partially in the first retainer opening 188, or that is positioned to be connected automatically to the first electrical interface 194 in response to positioning the retainer projection 196 at least partially in the first retainer opening 188. In other words, the first electrical interface 194 and the second electrical interface 198 may be positioned to be connected automatically in response to connecting the interchangeable module 118 to the support body 102. When first electrical interface 194 is connected to the second electrical interface 198, the first electrical interface 194 and the second electrical interface 198 may facilitate transfer of electrical power, transfer of one or more communication signals, or both transfer of electrical power and transfer of one or more communication signals between the support body 102 and the interchangeable module 118.

The interchangeable module 118 also includes a movable retainer projection 200 that is movable longitudinally relative to the rest of the interchangeable module 118. A spring 202 resiliently urges the movable retainer projection 200 longitudinally in a direction towards the retainer projection 196, and the movable retainer projection 200 is resiliently movable longitudinally in a direction away from the retainer projection 196, for example in response to force applied to an actuator 204 coupled to the movable retainer projection 200.

When the retainer projection 196 is received at least partially in the first retainer opening 188, the interchangeable module 118 is pivotable or otherwise movable relative to the support body 102 to allow the movable retainer projection 200 to move towards and away from the second retainer opening 192. Further, the movable retainer projection 200 is sized to be received at least partially in the second retainer opening 192 when the retainer projection 196 is received at least partially in the first retainer opening 188 and when the movable retainer projection 200 is in a retaining position as shown in FIG. 12. The spring 202 may hold the movable retainer projection 200 in the retaining position by urging the movable retainer projection 200 longitudinally in the direction towards the retainer projection 196. However, when the movable retainer projection 200 is moved longitudinally in the direction away from the retainer projection 196, for example in response to force applied to the actuator 204, the movable retainer projection 200 is in a releasing position in which the movable retainer projection 200 is removed from the second retainer opening 192 when the retainer projection 196 is received at least partially in the first retainer opening 188.

When the movable retainer projection 200 is in the releasing position, the interchangeable module 118 may be positioned with the movable retainer projection 200 near the second retainer opening 192, and then the movable retainer projection 200 may be moved into the retaining position (by resilient force from the spring 202, for example) to connect the interchangeable module 118 to the support body 102. Further, when the movable retainer projection 200 is in the releasing position, the interchangeable module 118 may be released from the support body 102. The retainer projection 196 and the movable retainer projection 200 may therefore facilitate a "quick connect" releasable connection.

The embodiment of FIG. 12 to FIG. 14 is an example only, and alternative embodiments may differ. For example, alternative embodiments may include different electrical connections, different retainers, or both different electrical connections and different retainers. In general, such a "quick connect" connection may include a latch, a pin, or another retaining body that is resiliently urged into a connected position by a spring or other resilient body, and that is movable out of such a connected position by a button or other actuator.

Illumination Apparatuses

As indicated above, an interchangeable module as described herein may be an illumination apparatus including one or more light sources. In general, illumination apparatuses such as those described herein may include one or more light sources, one or more light sources and one or more drivers or controllers for the one or more light sources, or one or more light sources, one or more drivers or controllers for the one or more light sources, and one or more power sources, for example. In some embodiments, such a controller may include a control card.

Illumination apparatuses such as those described herein may include one or more transparent or translucent bodies that may cover or enclose at least one of the one or more light sources. Such transparent or translucent bodies may have different parameters, such as different transmissivity, one or more different coatings surfaces of the transparent or translucent bodies, other parameters, or a combination of two or more thereof.

The one or more light sources of an illumination apparatus as described herein may include one or more light-emitting diodes ("LEDs"), one or more other solid-state emitters, one or more other light sources, or a combination of two or more thereof. The one or more light sources of an illumination apparatus may be the same or different, and may produce light of a single frequency or in a frequency spectrum determined by the one or more light sources. Further, a single frequency or frequency spectrum of light emitted by an illumination apparatus may be fixed or may be variable, for example to vary the frequencies themselves or to vary relative intensities of frequencies in a frequency spectrum. Further, an overall intensity of light emitted by an illumination apparatus may be fixed or may be variable. Such variation in frequency or in intensity may be in response to one or more communication signals received using communication interfaces such as those described above, for example.

Further, an illumination apparatus as described herein may include one or more than one light-emitting region, and different light-emitting regions of an illumination apparatus may vary. For example, light emitted from one light-emitting region may be in a single frequency or frequency spectrum, and light emitted from another light-emitting region may be in the same single frequency or frequency spectrum or in a different single frequency or frequency spectrum. Further, light emitted from one light-emitting region may have a different intensity from light emitted from another light-emitting region. Also, different light-emitting regions may be independently variable so that, for example, a frequency or frequency spectrum of light emitted from one light-emitting region may be varied independently from a frequency or frequency spectrum of light emitted from another light-emitting region, and intensity of light emitted from one light-emitting region may be varied independently from intensity of light emitted from another light-emitting region. Again, such variation in frequency or in intensity of different light-emitting regions may be in response to one or more communication signals received using communication interfaces such as those described above, for example.

In illumination apparatuses that include more than one light-emitting region, the light-emitting regions may direct light in different directions, in different regions, in different distributions over a region, or in a combination of two or more thereof. Further, in illumination apparatuses that include more than one light-emitting region, the light-emitting regions may be spatially distributed regularly or irregularly. In some embodiments, irregular spatial distribution of light-emitting regions of an illumination apparatus may enhance overall uniformity of light emitted from a plurality of illumination apparatuses.

Figure 15:
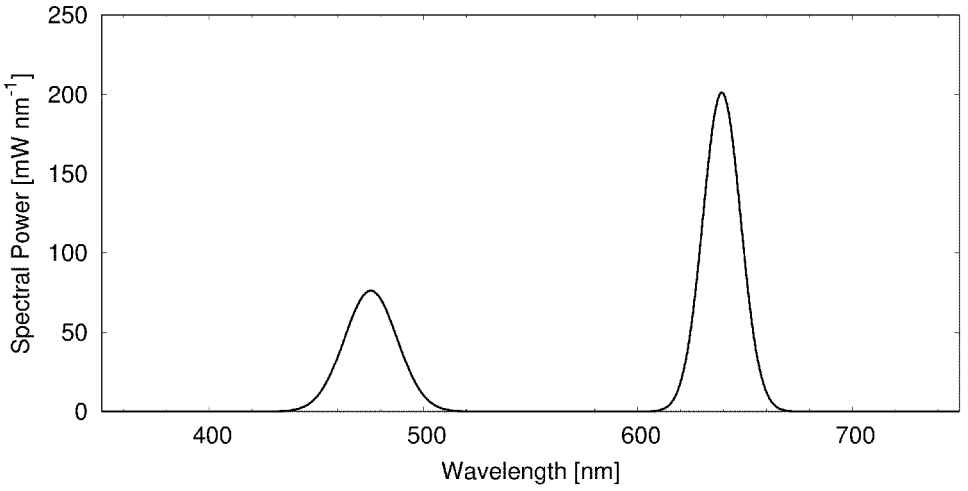
FIG. 15 illustrates a frequency spectrum of an illumination apparatus according to another embodiment.
Figure 16:
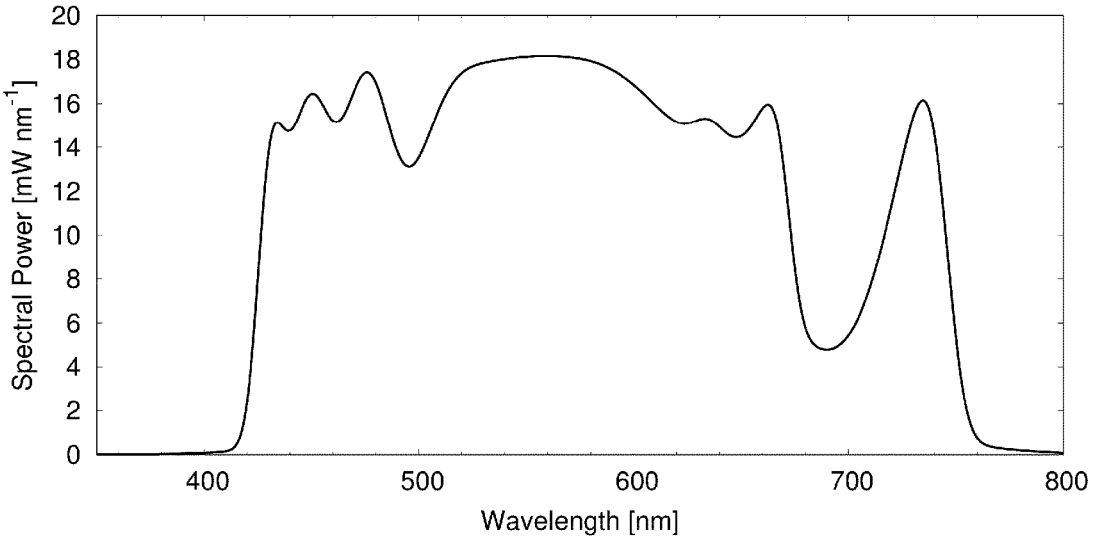
FIG. 16 illustrates a frequency spectrum of an illumination apparatus according to another embodiment.
Figure 17:
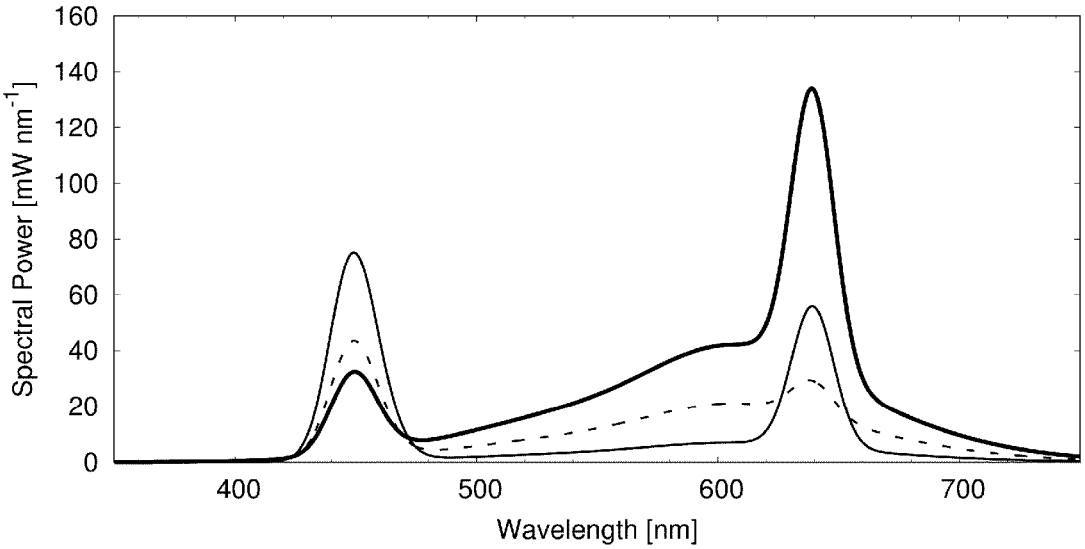
FIG. 17 illustrates three different frequency spectra of an illumination apparatus according to another embodiment.

In general, a single frequency or a frequency spectrum of light emitted by part or all of an illumination apparatus may be identified for one or more particular applications, such as for facilitating, optimizing, or improving one or more particular phases (such as a vegetative phase or a flowering phase) or one or more particular types (such as different types of crops) of plant growth, for example. FIG. 15 and FIG. 16 illustrate different frequency spectra of different illumination apparatuses according to different embodiments, although alternative embodiments may differ. Further, FIG. 17 illustrates three different frequency spectra of one illumination apparatus according one embodiment. In such an embodiment, the illumination apparatus may be configurable to emit light in any one of the three frequency spectra. In general, an illumination apparatus as described herein may be configured to emit light from one frequency spectrum, or may be configurable to emit light from one of more than one available frequency spectrum. Further, in general, an intensity of light emitted by part or all of an illumination apparatus may be identified for one or more such particular applications, and an illumination apparatus as described herein may be configured to emit light at one intensity, or may be configurable to emit light at one of more than one available intensity.

In some embodiments, for example, an illumination apparatus may emit light in three wavelength bands at set locations, and such wavelength bands may be about 450 nanometers ("nm") or about 660 nm for example, and may have a colour temperature of about 5,700 K, for example. Further, in some embodiments, a maximum intensity or photon flux density from an illumination apparatus on an incident plane may range from about 100 μmol per square meter per second ("$\mu mol/m^2/s$") to about 1,500 $\mu mol/m^2/s$, may be smaller or larger than such a range, or may be about 900 $\mu mol/m^2/s$, for example. Further, in some embodiments, photon flux from an illumination apparatus may range from about 100 μmol/s to about 2,500 μmol/s, may be smaller or larger than such a range, may be as high as 10 kilowatts ("kW") or as high as 20,000 μmol/s, for example. In general, one or more illumination apparatuses as described herein may be used to create a specific lighting environment for a specific crop, in combination with or compensating for other environmental conditions such as temperature, humidity, atmospheric composition, thereby evoking a response from such a crop. Further, LEDs at different wavelengths may mimic sunlight in some embodiments.

Further, different illumination apparatuses may produce light in different frequency spectra, and different illumination apparatuses may produce light in different intensities. Therefore, adding, removing, or substituting one or more illumination apparatuses releasably connected to a support body of a module system as described herein may change an overall frequency spectrum of light emitted from the module system, may change an overall intensity of light emitted from the module system, or may change both an overall frequency spectrum and an overall intensity of light emitted from the module system. As a result, embodiments such as those described herein may be configured to facilitate different phases or different plant types.

Figure 18:
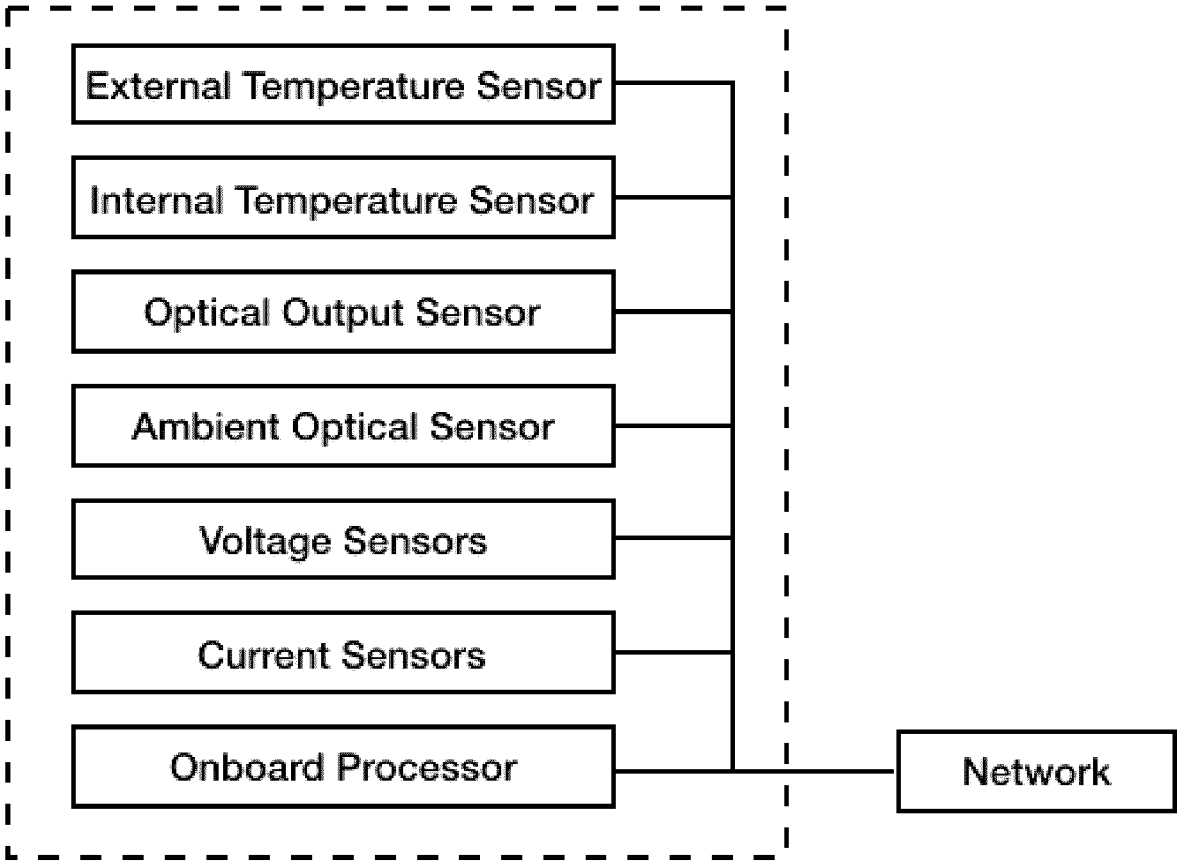
FIG. 18 illustrates an illumination apparatus according to another embodiment.

An illumination apparatus according to one embodiment is illustrated schematically in FIG. 18 and includes an internal temperature sensor configured to sense an internal temperature of the sensor apparatus, an external temperature sensor configured to sense an external temperature of the sensor apparatus, an optical output sensor configured to sense light emitted from the apparatus, an ambient optical sensor configured to sense ambient light, one or more voltage sensors, one or more current sensors, and a processor, all in communication with a network (for example, a local network, the Internet, or both). The apparatus of FIG. 18 is an example only, and alternative embodiments may differ. For example, alternative embodiments may include fewer, different, or more sensors or other components.

Figure 19:
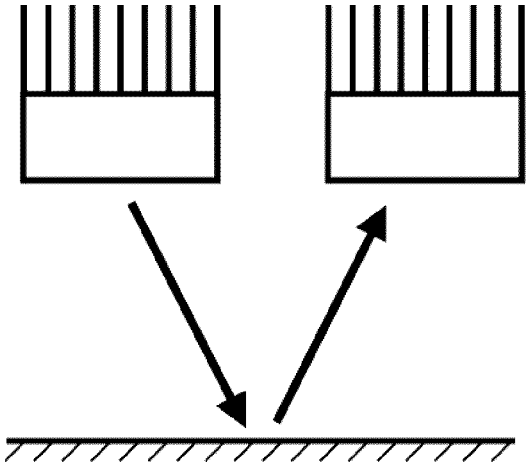
FIG. 19 illustrates a module system according to another embodiment.
Figure 20:
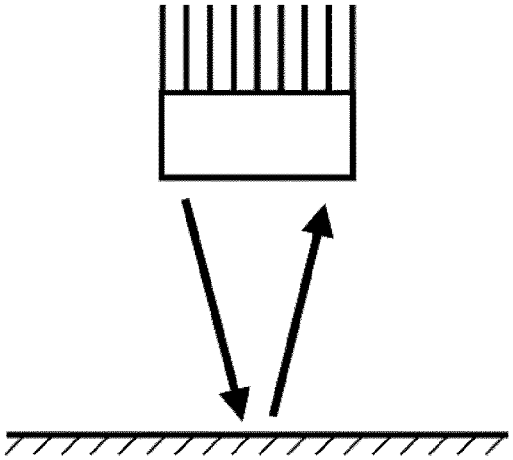
FIG. 20 illustrates a module system according to another embodiment.

In some embodiments, illumination apparatuses may be capable of one or more additional functions, such as any combination of some or all of:

1. monitoring its internal operating temperature;
2. monitoring its external ambient temperature environment;
3. monitoring its current and voltage characteristics in general;
4. monitoring its current and voltage characteristics for each wavelength it emits;
5. monitoring its current and voltage characteristics for each of sets of LEDs connected in a serial circuit;
6. monitoring its optical output in general;
7. monitoring its optical output for each wavelength it emits;

8. monitoring its optical output for each of sets of LEDs connected in a serial circuit;
9. reporting results of its monitoring to an operator;
10. reporting results of its monitoring to a network (for example, a local network, the Internet, or both);
11. changing its operation in response to results of one or more of its self-monitoring sensors;
12. receiving instructions on how to change its operation in response to results of its self-monitoring (for example, receiving updated parameters for efficient performance from a database, from a local network, from the Internet, or from a combination of two or more of the preceding);
13. receiving updated firmware code (for example, from a local network, from the Internet, or from both);
14. reporting its identity (such as a unique serial number, for example) to a network (for example, a local network, the Internet, or both);
15. transmitting optical signals encoded with information (such as its unique serial number, for example);
16. detecting optical signals encoded with information from other interchangeable modules (illustrated schematically in FIG. 19, for example);
17. detecting spectroscopic signals from the ambient environment (for example, an optical signal transmitted from the same illumination apparatus, as illustrated schematically in FIG. 20, or from another illumination apparatus, which may be on the same or different support body, as illustrated schematically in FIGS. 19); and
18. detecting spectroscopic intensity from the ambient environment (for example, an optical signal transmitted from the same illumination apparatus, as illustrated schematically in FIG. 20, or from another illumination apparatus, which may be on the same or different support body, as illustrated schematically in FIG. 19).

Sensor Apparatuses

As indicated above, an interchangeable module as described herein may additionally or alternatively be a sensor apparatus configured to monitor plant growth, to monitor an environment of plant growth, or both. For example, such a sensor may include a light sensor configured to sense light, an optical reflectance sensor configured to sense optical reflectance, a humidity configured to sense humidity (such as relative humidity, for example), a temperature sensor configured to sense temperature (such as canopy temperature, leaf temperature, or ambient temperature, for example), a carbon dioxide concentration sensor configured to sense carbon dioxide concentration, a plant growth sensors configured to sense plant growth, or a combination of two or more thereof. Such a plant growth sensor may include, for example, a plant height sensor, a reflectance sensor, a leaf temperature sensor, a fluorescence sensor, or a camera. Such sensors may differ in sensitivity, in optical field of view (in the case of optical sensors), in measurement location (in the case of sensors such as humidity sensors, temperature sensors, and carbon dioxide concentration sensors, for example), in one or more other parameters, or in a combination of two or more thereof.

Measurements from such sensor apparatuses may be transmitted in one or more communication signals transmitted using communication interfaces such as those described above, for example.

In some embodiments, sensor apparatuses may be capable of one or more additional functions, such as any combination of some or all of:
1. reporting results of its monitoring to an operator;
2. reporting results of its monitoring to a network (for example, a local network, the Internet, or both);
3. receiving instructions on how to change its operation in response to results of its self-monitoring (for example, receiving updated parameters for efficient performance from a database, from a local network, from the Internet, or from a combination of two or more of the preceding);
4. receiving updated firmware code (for example, from a local network, from the Internet, or from both);
5. reporting its identity (such as a unique serial number, for example) to a network (for example, a local network, the Internet, or both);
6. transmitting optical signals encoded with information (such as its unique serial number, for example);
7. detecting optical signals encoded with information from other interchangeable modules; and
8. detecting spectroscopic intensity from the ambient environment (for example, an optical signal transmitted from the same illumination apparatus, as illustrated schematically in FIG. 20, or from another illumination apparatus, which may be on the same or different support body, as illustrated schematically in FIG. 19).

Module Systems

In general, an interchangeable module as described herein—whether an illumination apparatus, a sensor apparatus, both an illumination apparatus and a sensor apparatus, or another interchangeable module—may be releasably connectable to one, to more than one, or to all of the connection regions of a support body as described herein, and may be releasably connected in different ways (such as transversely as shown in FIG. 1 to FIG. 8, or depending or cantilevered as shown in FIG. 9, or otherwise) and with different spacing (as shown in FIG. 1 to FIG. 5 or otherwise).

Accordingly, in embodiments such as those described herein, a support body may act as a node, as a defining point for one or more interchangeable modules, and as a physical means for attachment for one or more interchangeable modules. Further, support bodies such as those described herein may facilitate a wide range of positions and orientations of interchangeable modules relative to a support body, which may facilitate a wide range of positions and orientations of illumination apparatuses, sensor apparatuses, or both.

In some embodiments, support bodies releasably connected to one or more interchangeable modules may be capable of one or more additional functions, such as any combination of some or all of:
1. transmitting from one interchangeable module releasably connected to the support body, with the transmission received by one or more other interchangeable modules releasably connected to the support body;
2. adjusting one or more operating characteristics of one or more interchangeable modules releasably connected to the support body in response to measurements or monitoring of one or more other interchangeable modules releasably connected to the support body;
3. adjusting one or more operating characteristics of one or more interchangeable modules releasably connected to the support body in response to commands of a central computer; and
4. adjusting one or more operating characteristics of one or more interchangeable modules releasably connected to the support body in response to commands of a central computer after reporting internal or external measurements.

Figure 21:
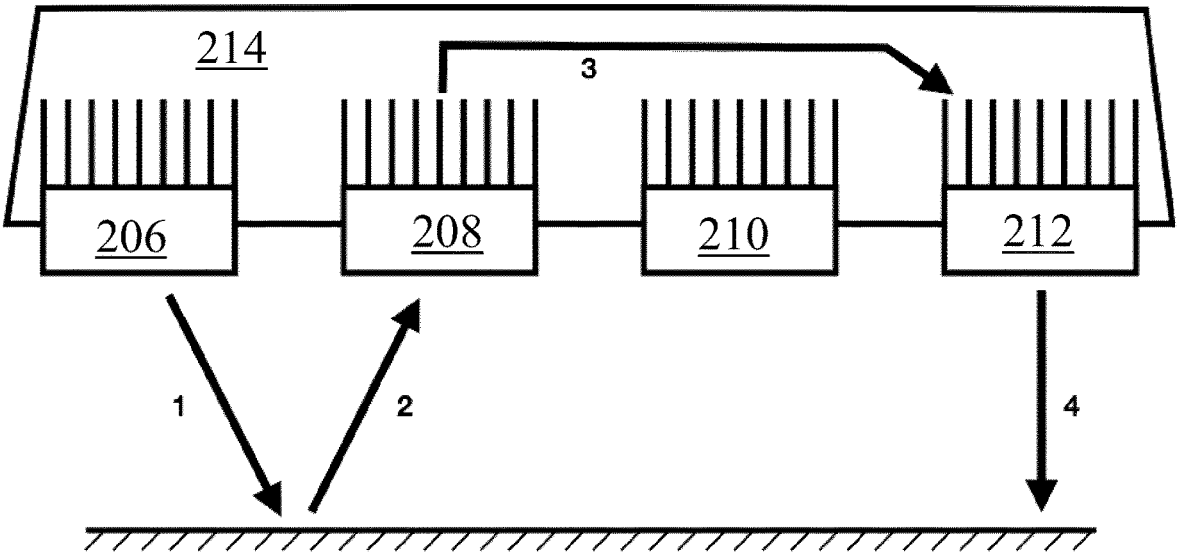
FIG. 21 illustrates a module system according to another embodiment.

An example of such a function is illustrated in FIG. 21, a module system according to one embodiment includes four illumination apparatuses 206, 208, 210, and 212 releasably connected to a support body 214. In the embodiment shown, the illumination apparatus 206 emits at least one optical signal 1, which interacts with environment and is received by the illumination apparatus 208 as at least one optical signal 2. Also, in the embodiment shown, the support body 214 processes information, makes a decision, and in response to the at least one optical signal 2, transmits at least one signal 3, and at least one operating characteristic of the illumination apparatus 212 changes in response with at least one optical output 4.

In other words, when a support body is releasably connected to one or more interchangeable modules, the support body may facilitate communication between the support body and the one or more interchangeable modules with or without communication outside of the support body and the one or more interchangeable modules.

Further, as indicated above, different illumination apparatuses may produce light in different frequency spectra, and different illumination apparatuses may produce light in different intensities. Therefore, embodiments such as those described herein may facilitate not only a wide range of positions and orientations of illumination apparatuses and sensor apparatuses, but also selectable illumination apparatuses to select different frequency spectra, different intensities, or both different frequency spectra and different intensities for some or all of the illumination apparatuses in a module system and therefore in different regions of the module system.

Further, because interchangeable modules as described herein and may be releasably connected in different ways (such as transversely as shown in FIG. 1 to FIG. 8, or depending or cantilevered as shown in FIG. 9, or otherwise) and with different spacing (as shown in FIG. 1 to FIG. 5 or otherwise), embodiments such as those described herein may facilitate selecting different frequency spectra, different intensities, or both different frequency spectra and different intensities for light emitted from different regions of a module system, light emitted in different directions from a module system, and regions or directions where sensors such as those described above may be positioned or oriented in order to sense properties such as those described above, for example.

Further, an interchangeable module as described herein may be configured to identify a location automatically in response to releasable connection to a connection region of a support body (for example in response to receiving one or more communication signals from a communication interface as described above), and may be configured to determine one or more parameters (such as determination of frequency, intensity, or both of light emitted from one or more light-emitting regions, or determination of sensitivity or one or more other parameters of a sensor, for example) automatically in response to such location identification. Further, an interchangeable module as described herein may be configured to self-index automatically in response to releasable connection to a connection region of a support body, which may facilitate network communication with the interchangeable module or centralized control of the interchangeable module. Therefore, an interchangeable module as described herein may enable automatic configuration upon connection.

Further, in module systems such as those described herein, when an interchangeable module is releasably connected to a connection region of a support body, the system automatically identify, transmit, or identify and transmit information associated with the interchangeable module. For example, information associated with an interchangeable module may include information identifying the interchangeable module (such as a serial number or other identifier of the interchangeable module, for example), may include information identifying at least one function of the first at least one interchangeable module (such as information identifying frequency spectra or intensities that the interchangeable module is configured to emit, or types of sensors that the interchangeable module includes, for example), other information, or a combination of two or more thereof. Such information associated with the interchangeable module may be transmitted to the support body that the interchangeable module is releasably connected to, to one or more other support bodies, to a central computer, to another device, or to a combination of two or more thereof. Identifying or transmitting such information associated with the interchangeable module may facilitate coordinating illumination or monitoring across an area as described herein, for example.

Further, in module systems such as those described herein, interchangeable modules may transmit one or more optical signals to one or more other interchangeable modules, and such transmissions may facilitate identifying locations of interchangeable modules. For example, a first interchangeable module may transmit at least one optical signal, and a second interchangeable module spaced apart from the first interchangeable module may measure the at least one optical signal. Then, at least one processor may estimate a respective location of one or both of the first and second interchangeable modules at least in response to the at least one optical signal and in response to measurement of the at least one optical signal at the second one of the plurality of illumination apparatuses. For example, the at least one optical signal may be encoded with information or may include one or more frequencies identifying the first interchangeable module, and measurement of the at least one optical signal may identify a location of one or both of the first and second interchangeable modules. The first and second interchangeable modules may be releasably connected to the same or different support bodies.

In summary, an overall installation can be made up of one or more module systems such as those described herein, which may be supported or installed in a regular or irregular spatial arrangement in, for example, one or more greenhouses, one or more indoor agriculture facilities, one or more vertical farms, one or more growth chambers, or one or more research laboratories, or in a combination of two or more thereof. The function of each module system, and of the overall installation, may be changed relatively easily by changing some or all of the interchangeable modules as described herein, for example.

In embodiments such as those described above, one or more support bodies may be positioned and oriented in many different ways, and one or more interchangeable modules may be releasably connected to the one or more support bodies to provide a useful illumination pattern. Further, intensity of light from one or more illumination apparatuses may also provide a useful illumination pattern.

Figure 22:
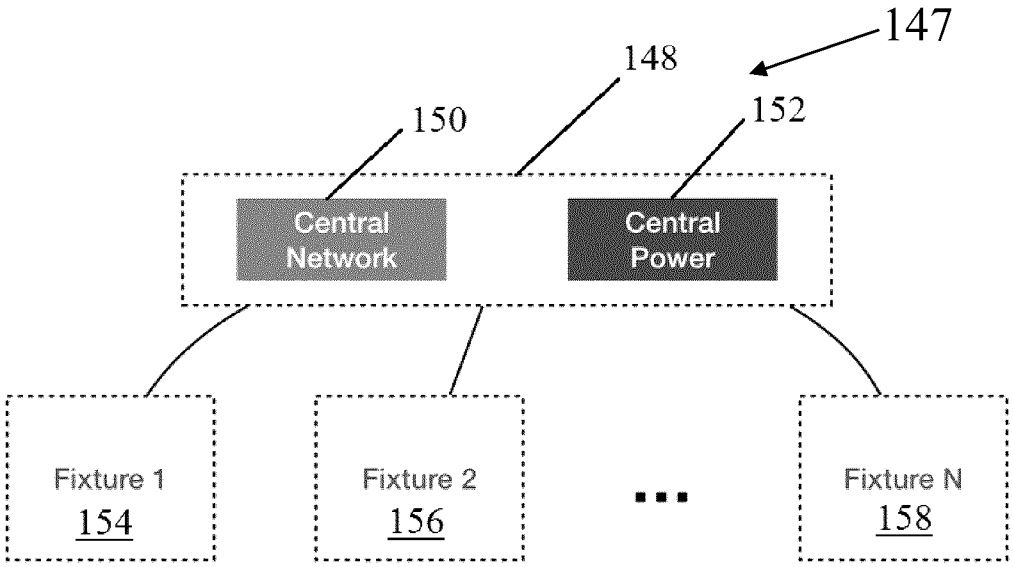
FIG. 22 illustrates a module system according to another embodiment.

Such one or more module systems may be interconnected, for example to a central point of control to enable centralized control of functionality across all of the module systems. For example, referring to FIG. 22, a module system according to another embodiment is shown generally at 147 and includes a central control system or hub 148 including a central network component 150 and a central power component 152. The module system 147 also includes module systems (or fixture systems) 154, 156, and 158 that may be similar to the module system 100 (shown in FIG. 1) for example, and that may be distributed in, for example, one or more greenhouses, one or more indoor agriculture facilities, one or more vertical farms, one or more growth chambers, or one or more research laboratories, or in a combination of two or more thereof.

The module systems 154, 156, and 158 may each include a support body and any number of interchangeable modules. The support bodies and interchangeable modules may communicate with the central network component 150 and may receive power from the central power 152 as described above, for example. Therefore, the central control system 148 may control operation of some or all of any of the interchangeable modules that are (or that include) illumination apparatuses. Further, the central control system 148 may receive sensor data from some or all of any of the interchangeable modules that are (or that include) sensor apparatuses. Further, the central control system 148 may control operation of some or all of any of the interchangeable modules that are (or that include) illumination apparatuses at least partly in response to feedback such as sensor data received from some or all of any of the interchangeable modules that are (or that include) sensor apparatuses.

In some embodiments, a central control system as described above may be integrated with a facility control system.

Figure 23:
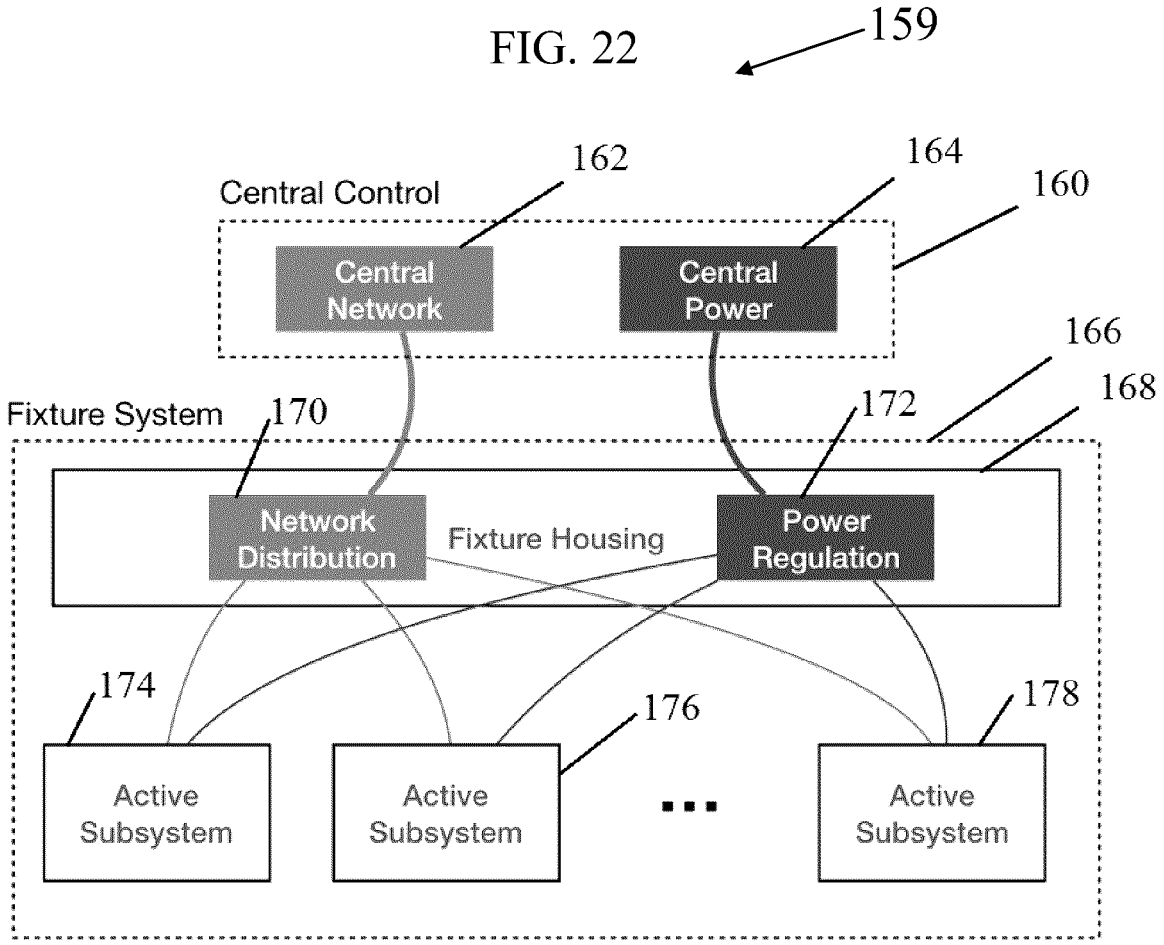
FIG. 23 illustrates a module system according to another embodiment.

Referring to FIG. 23, a module system according to another embodiment is shown generally at 159 and includes a central control system or hub 160 including a central network component 162 and a central power component 164. The module system 159 also includes one or more module systems (or fixture systems) including a module system (or fixture system) 166 that may be similar to the module system 100 for example. Again, in general, such one or more module systems (or fixture systems) including the module system (or fixture system) 166 may be distributed in, for example, one or more greenhouses, one or more indoor agriculture facilities, one or more growth chambers, or one or more research laboratories, or in a combination of two or more thereof.

The module system 166 includes a support body (or fixture housing) 168, which may be similar to the support body 102 (shown in FIG. 1), and which may include a network distribution component 170 and a power regulation component 172. Any number of interchangeable modules (or active subsystems) may be releasably connected to the support body 168, such as interchangeable modules 174, 176, and 178 in the embodiment shown. In general, the interchangeable modules may receive power from the support body 168, which may receive power from the central power component 164. Likewise, in other support bodies of the module system 166, interchangeable modules may be receive power from the support body 168, which may receive power from the central power component 164.

Further, the support bodies and interchangeable modules may communicate with the central network component 162. Therefore, the central control system 160 may control operation of some or all of any of the interchangeable modules that are (or that include) illumination apparatuses. Further, the central control system 160 may receive sensor data from some or all of any of the interchangeable modules that are (or that include) sensor apparatuses. Further, the central control system 160 may control operation of some or all of any of the interchangeable modules that are (or that include) illumination apparatuses at least partly in response to sensor data received from some or all of any of the interchangeable modules that are (or that include) sensor apparatuses.

Figure 24:
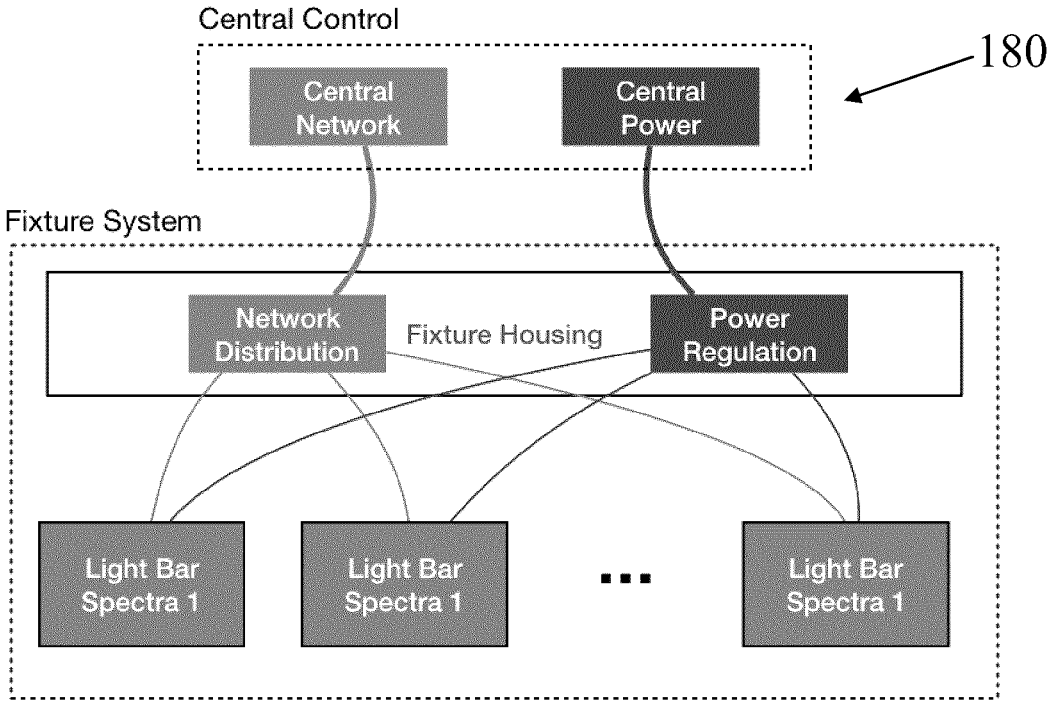
FIG. 24 illustrates a module system according to another embodiment.

Referring to FIG. 24, a module system according to another embodiment is shown generally at 180 and includes an initial configuration of interchangeable modules. In the embodiment shown, the interchangeable modules are illumination apparatuses that emit light in a common frequency spectrum.

Figure 25:
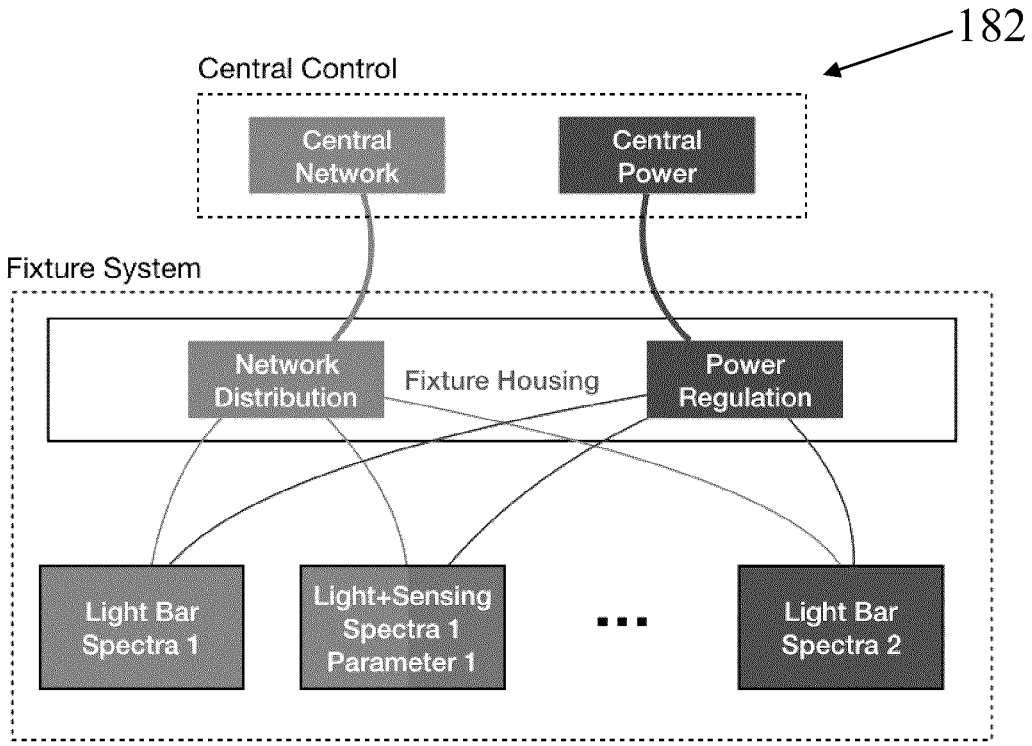
FIG. 25 illustrates a module system according to another embodiment.

However, referring to FIG. 25, a module system according to another embodiment is shown generally at 182 and includes a modified or upgraded configuration of the interchangeable modules of FIG. 24 in which one of the interchangeable modules is one of the illumination apparatuses of FIG. 24, another of the interchangeable modules is a combination of a sensor apparatus and an illumination apparatus that emits light in the frequency spectrum of FIG. 24, and another of the interchangeable modules is an illumination apparatus that emits light in a frequency spectrum different from the frequency spectrum of FIG. 24. The embodiment of FIG. 25 is an example only, and in general, embodiments such as those described herein may be varied by interchanging interchangeable modules.

In some embodiments, a module system including more than one support body, each releasably connected to one or more interchangeable modules, may be capable of one or more of various functions. For example, such support bodies may communicate with each other using a local network, the Internet, or both. Further, in such embodiments, locations (either relative or absolute) of the interchangeable modules may be identified, for example automatically in response to releasably connecting the interchangeable modules to respective connecting regions of respective support bodies. Further, such interchangeable modules may have respective different identifiers (such as unique serial numbers, for example) to facilitate such functions.

In general, such a module system may control output, settings, or one or more operational characteristics, or a combination of two or more thereof, of one or more of the support bodies (or of one or more interchangeable modules releasably connected to the support bodies) in response to measurements or monitoring of one or more of other support bodies (or of one or more interchangeable modules releasably connected to the other support bodies).

Figure 26:
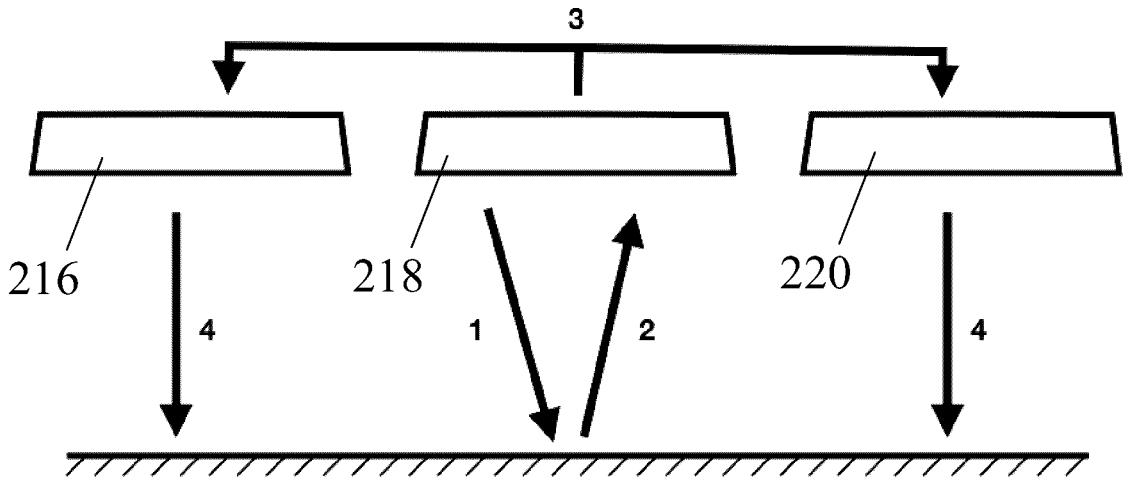
FIG. 26 illustrates a module system according to another embodiment.

For example, referring to FIG. 26, a module system according to one embodiment includes three support bodies 216, 218, and 220. At least one interchangeable module is releasably connected to each of the support bodies 216, 218, and 220. In the embodiment shown, at least one interchangeable module releasably connected to the support body 218 emits at least one optical signal 1, which interacts with environment and is received by an interchangeable module releasably connected to the support body 218 as optical signal 2. In response, the support body 218 transmits at least one signal 3, and a central computer evaluates information and makes a decision, which is relayed to the support bodies 216 and 220. At least one interchangeable module releasably connected to the support body 216, and at least one interchangeable module releasably connected to the support body 220, take action 4 in response to the at least one signal 3, and based on the evaluation of the central computer, the action 4 by the support body 216 may be the same as or different from the action 4 by the support body 220.

In other words, in embodiments such as the embodiment of FIG. 26, at least one interchangeable module of one support body may emit at least one optical signal, which may interact with ambient environment, and which may be received by at least one interchangeable module of the same support body as a modified at least one optical signal. In such an embodiment, a measurement of the modified at least one optical signal may be transmitted to a central computer, which may transmit updated instructions to one or more support bodies to change operation of the one or more support bodies, of one or more interchangeable modules releasably connected to the one or more support bodies, or both. Such changes of operation may be the same, or may vary. For example, operation of one or more interchangeable modules may change in response to respective locations of the one or more interchangeable modules, in response to respective capabilities of the one or more interchangeable modules, or both.

Figure 27:
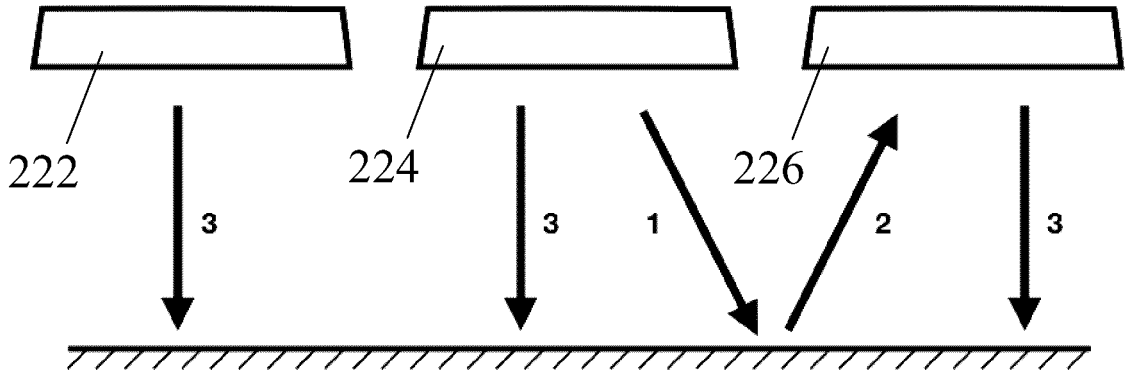
FIG. 27 illustrates a module system according to another embodiment.

As another example, referring to FIG. 27, a module system according to one embodiment includes three support bodies 222, 224, and 226. At least one interchangeable module is releasably connected to each of the support bodies 222, 224, and 226. In the embodiment shown, at least one interchangeable module releasably connected to the support body 224 emits at least one optical signal 1, which propagates to the environment and interacts with a region in the environment. In response, at least one optical signal 2 is received by at least one interchangeable module releasably connected to the support body 226. In response to the at least one optical signal 2, at least one interchangeable module releasably connected to the support body 226 may change its operation with at least one action 3, with or without communicating with a central computer. Also, in response to the at least one optical signal 2, the support body 226 may transmit information about the at least one optical signal 2 to a central computer, which may communicate with one or more other support bodies (such as the support body 222, the support body 224, or both), which may change their operation with at least one action 3.

In other words, in embodiments such as the embodiment of FIG. 27, at least one interchangeable module of one support body may emit at least one optical signal, which may interact with ambient environment, and which may be received by at least one interchangeable module of another support body as a modified optical signal. In such an embodiment, a measurement of the modified at least one optical signal may be transmitted to a central computer, which may transmit updated instructions to one or more support bodies to change operation of the one or more support bodies, of one or more interchangeable modules releasably connected to the one or more support bodies, or both. Such changes of operation may be the same, or may vary. For example, operation of one or more interchangeable modules may change in response to respective locations of the one or more interchangeable modules, in response to respective capabilities of the one or more interchangeable modules, or both.

Figure 28:
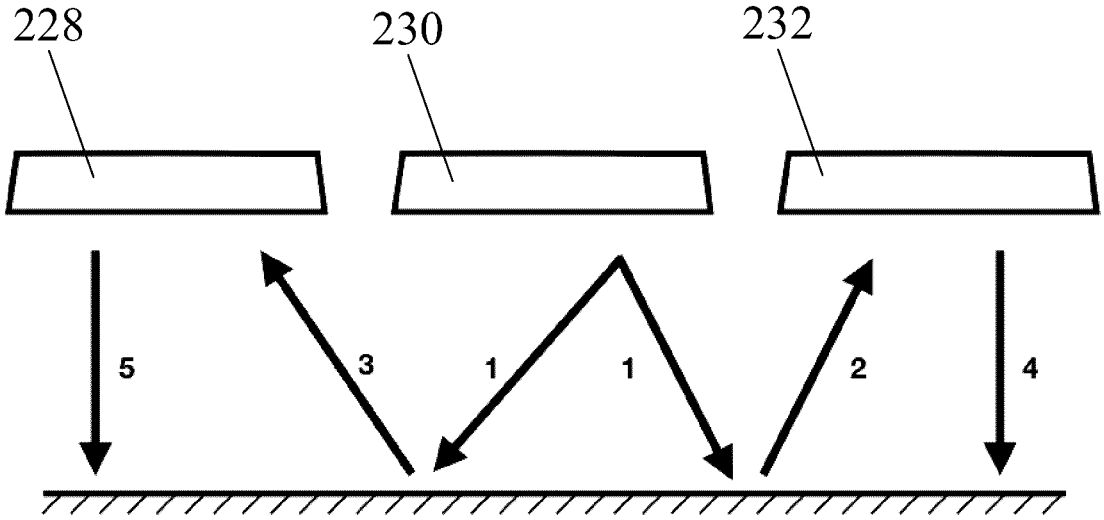
FIG. 28 illustrates a module system according to another embodiment.

As another example, referring to FIG. 28, a module system according to one embodiment includes three support bodies 228, 230, and 232. At least one interchangeable module is releasably connected to each of the support bodies 228, 230, and 232. In the embodiment shown, at least one interchangeable module releasably connected to the support body 230 emits at least one optical signal 1, which propagates to the environment and interacts with one or more regions of the environment. In the embodiment of FIG. 28, the at least one optical signal 1 has interacted with two regions, although alternative embodiments may differ, and optical signals may interact with fewer or more regions of the environment. In response to the at least one optical signal 1, at least one optical signal 2 is received by at least one interchangeable module releasably connected to the support body 232, and at least one optical signal 3 is received by at least one interchangeable module releasably connected to the support body 228. In response to the at least one optical signal 2, the support body 232 (or at least one interchangeable module releasably connected to the support body 232) may change its operation with at least one action 4, with or without communicating with a central computer. Also, in response to the at least one optical signal 3, the support body 228 (or at least one interchangeable module releasably connected to the support body 228) may change its operation with at least one action 5, with or without communicating with a central computer. In some cases, the at least one optical signal 2, the at least one optical signal 3, or both may be encoded with information that may be used (by a central computer, for example) to determine the at least one action 4, the at least one action 5, or both.

In other words, in embodiments such as the embodiment of FIG. 28, at least one interchangeable module of one support body may emit at least one optical signal, which may interact with ambient environment, and which may be received by at least one interchangeable module of one or more different support bodies as a modified optical signal. In such an embodiment, a measurement of the modified at least one optical signal may be transmitted to a central computer, which may transmit updated instructions to one or more support bodies to change operation of the one or more support bodies, of one or more interchangeable modules releasably connected to the one or more support bodies, or both. Such changes of operation may be the same, or may vary. For example, operation of one or more interchangeable modules may change in response to respective locations of the one or more interchangeable modules, in response to respective capabilities of the one or more interchangeable modules, or both.

In general, embodiments such as those described herein may be used in horticulture or in other applications, for example to facilitate control of light emitted from a module system and therefore to facilitate plant growth or to facilitate control of plant growth. Embodiments such as those described herein may facilitate relatively easy and cost-effective additions and upgrades, for example to facilitate increased features and functionality. The modularity of embodiments such as those described herein may facilitate selecting and changing lighting, sensing, control, or a combination of two or more thereof, for example by added, removing, re-arranging, interchanging, upgrading, downgrading, or otherwise changing interchangeable modules such as those described herein. Such reconfiguration may facilitate changing different functions, features, specifications, or a combination of two or more thereof, which may facilitate plant growth for different phases of a growth cycle (such as a vegetative phase or a flowering phase), for changing crop type, for changing yield, quality, chemical content, harvest cycle time, energy use or efficiency, or a combination of two or more thereof, or for upgrading overall system performance, for example.

Although specific embodiments have been described and illustrated, such embodiments should be considered illustrative only and not as limiting the invention as construed according to the accompanying claims.

The invention claimed is:

1. A method of estimating a respective location of at least one of a plurality of interchangeable modules releasably connected to respective different connection regions of at least one support body, the method comprising:

causing a first one of the plurality of interchangeable modules to transmit at least one optical signal;

causing a second one of the plurality of interchangeable modules, spaced apart from the first one of the plurality of interchangeable modules, to measure the at least one optical signal; and causing at least one processor to estimate a respective location of one or both of the first and second ones of the plurality of interchangeable modules at least in response to the at least one optical signal and in response to measurement of the at least one optical signal at the second one of the plurality of interchangeable modules.

2. The method of claim 1 wherein the first and second ones of the plurality of interchangeable modules are releasably connected to a same support body.

3. The method of claim 1 wherein the first and second ones of the plurality of interchangeable modules are releasably connected to separate support bodies spaced apart from each other.

4. A system comprising:

at least one support body comprising a respective plurality of connection regions;

a first interchangeable module configured to be connected releasably to at least one of the plurality of connection regions;

a second interchangeable module configured to be connected releasably to at least one of the plurality of connection regions; and at least one processor configured to, at least:

cause the first interchangeable module to transmit at least one optical signal when the first interchangeable module is connected releasably to a first one of the connection regions;

cause the second interchangeable module to measure the at least one optical signal when the second interchangeable module is connected releasably to a second one of the connection regions spaced apart from the first one of the connection regions; and estimate a respective location of one or both of the first and second interchangeable modules at least in response to the at least one optical signal and in response to measurement of the at least one optical signal at the second interchangeable module.

* * * * *